US012188468B2

(12) United States Patent
Zier

(10) Patent No.: US 12,188,468 B2
(45) Date of Patent: Jan. 7, 2025

(54) RESERVOIR FOR DUAL LOOP LUBRICATION AND THERMAL MANAGEMENT SYSTEM FOR PUMPS

(71) Applicant: EKU POWER DRIVES INC., Spring, TX (US)

(72) Inventor: Benedikt Peter Zier, Leinfelden-Echterdingen (DE)

(73) Assignee: EKU POWER DRIVES INC., Spring, TX (US)

( * ) Notice: Subject to any disclaimer, the term of this patent is extended or adjusted under 35 U.S.C. 154(b) by 12 days.

(21) Appl. No.: 17/901,725

(22) Filed: Sep. 1, 2022

(65) Prior Publication Data

US 2024/0077073 A1 Mar. 7, 2024

(51) Int. Cl.
*F04B 53/08* (2006.01)
*F04B 53/18* (2006.01)

(52) U.S. Cl.
CPC ..... *F04B 53/08* (2013.01); *F04B 53/18* (2013.01)

(58) Field of Classification Search
CPC ..... F01M 11/0004; F01M 1/02; F01M 1/16; F01M 2005/023; F01M 2011/0045; F01M 5/005; F01M 5/02; F01M 5/002; F01M 2011/0037; F01M 2011/0033; F01M 11/04; F01M 11/02; F04B 53/08; F04B 53/18
USPC ..... 184/12, 22, 28
See application file for complete search history.

(56) References Cited

U.S. PATENT DOCUMENTS 1,365,438 A * 1/1921 Adamson ..... F01M 11/065 220/675
1,910,375 A * 5/1933 Woolson ..... F01M 11/061 184/6
2,051,026 A * 8/1936 Booth ..... F01M 5/002 137/264
2,827,342 A * 3/1958 Roach ..... F16C 32/0659 384/291
3,416,633 A * 12/1968 Swearingen ..... F16N 39/04 184/104.1

(Continued)

FOREIGN PATENT DOCUMENTS

DE 100 02 256 B4 6/2008

OTHER PUBLICATIONS

Shuck, B., et al., "An Optimal Lubrication System Holds the Key", Weir Oil & Gas, Jan. 1, 2017, 5 pages.

(Continued)

*Primary Examiner* — Henry Y Liu
(74) *Attorney, Agent, or Firm* — Lathrop GPM LLP

(57) ABSTRACT

A device including a reservoir configured to contain a lubricant. One or more sets of baffles are disposed in the reservoir. The one or more sets of baffles separate the reservoir into a hot zone and a cold zone. The one or more sets of baffles permit at least some flow of the lubricant between the hot zone and the cold zone. The device also includes a machine loop drain placed in the reservoir to drain lubricant returning from a machine into the hot zone. The device also includes a thermal management loop drain placed in the reservoir to drain lubricant returning from a thermal management system into the cold zone. The device also includes a thermal management loop inlet placed in the reservoir to draw lubricant from the hot zone. The device also includes a machine loop inlet placed in the reservoir to draw lubricant from the cold zone.

20 Claims, 8 Drawing Sheets

(56) References Cited

U.S. PATENT DOCUMENTS 4,134,380 A * 1/1979 Niwa ..... F01M 11/06 123/196 R
4,375,785 A * 3/1983 Schoch ..... B30B 15/0088 165/47
4,498,525 A * 2/1985 Smith ..... F02C 7/14 123/557
4,616,609 A * 10/1986 Munch ..... F01M 11/0004 123/196 R
5,275,258 A * 1/1994 Bousseau ..... F16C 17/24 123/196 S
5,301,642 A * 4/1994 Matsushiro ..... F01M 5/001 123/196 AB
5,339,776 A * 8/1994 Regueiro ..... F01M 1/16 123/196 AB
5,517,959 A * 5/1996 Kato ..... F01M 1/02 184/104.1
5,653,205 A * 8/1997 Ozeki ..... F01M 11/0004 123/196 R
5,937,817 A * 8/1999 Schanz ..... F16H 57/04 123/196 R
6,416,373 B1 * 7/2002 Kolb ..... B63H 20/002 440/88 L
6,457,564 B1 * 10/2002 Damm ..... F16H 57/0434 184/104.3
6,488,479 B1 * 12/2002 Berger ..... F04B 53/18 417/310
6,598,705 B2 * 7/2003 Ito ..... F01M 1/12 184/6.4
7,308,882 B2 * 12/2007 Suzuki ..... F01M 1/16 123/196 CP
7,334,556 B2 * 2/2008 Wachigai ..... B62K 11/00 123/196 R
7,490,586 B1 * 2/2009 Weller ..... F01M 9/02 184/104.2
7,654,241 B2 * 2/2010 Kobayashi ..... F01M 5/001 184/104.2
7,992,535 B2 * 8/2011 Steiner ..... F02B 39/14 123/196 AB
8,292,037 B2 * 10/2012 Kawamura ..... F01M 1/12 123/196 R
8,506,816 B2 * 8/2013 Mordukhovich .... B01D 63/082 210/167.04
9,664,077 B2 5/2017 Zahdeh
9,856,764 B2 * 1/2018 Pegg ..... F01M 9/105
9,879,588 B2 * 1/2018 Kamimura ..... F01M 1/06
10,352,321 B2 * 7/2019 Byrne ..... F04B 1/0404
2004/0182566 A1 * 9/2004 Jainek ..... B01D 35/16 165/300
2008/0066982 A1 * 3/2008 Kobayashi ..... F01M 11/0004 180/69.1
2009/0078219 A1 * 3/2009 Marsh ..... F01P 1/06 123/41.02
2010/0025159 A1 2/2010 Gmirya et al.
2015/0300220 A1 * 10/2015 Mordukhovich ... F16H 57/0452 184/106
2016/0326922 A1 * 11/2016 Wordsworth ..... F01M 1/16
2016/0363095 A1 * 12/2016 Newman ..... F02F 7/0012
2018/0238635 A1 * 8/2018 Chopard ..... B60H 1/3202
2019/0072015 A1 * 3/2019 Hutchins ..... F01M 11/0004

OTHER PUBLICATIONS

International Search Report and Written Opinion for related application No. PCT/US2023/031757, mailed on Dec. 20, 2023, 10 pages.

* cited by examiner

RESERVOIR FOR DUAL LOOP LUBRICATION AND THERMAL MANAGEMENT SYSTEM FOR PUMPS

BACKGROUND

Reciprocating pumps are used during production in the oil and gas industry. A reciprocating pump may be lubricated with a lubricant, such as oil. The lubricant may be at an elevated temperature and pressure relative to the temperature and pressure of the environment surrounding the reciprocating pump.

The engineering tolerances for the lubricant pressure and lubricant temperature may be managed in a single loop system. A loop system is a series of pipes, lubricated machinery, cooling systems, and other fluid management systems that are in either direct or indirect fluid communication with each other. In a single loop system, the core components (e.g., a machine being lubricated, a pump, a filter, and a radiator) are all in the same loop system. However, the different core components may desirably operate at different lubricant temperature or pressure ranges. Nevertheless, a single loop system may require a single range be set for lubricant temperatures or pressures. Setting the single range of lubricant temperatures or pressures may involve a trade-off, where some core components may operate at a lower than optimal set of engineering tolerances, and other core components may operate at a higher than optimal set of engineering tolerances.

SUMMARY

The one or more embodiments provide for a device. The device includes a reservoir configured to contain a lubricant. The device also includes one or more sets of baffles disposed in the reservoir. The one or more sets of baffles separate the reservoir into a hot zone and a cold zone. The one or more sets of baffles permit at least some flow of the lubricant between the hot zone and the cold zone. The device also includes a machine loop drain placed in the reservoir to drain lubricant returning from a machine into the hot zone. The device also includes a thermal management loop drain placed in the reservoir to drain lubricant returning from a thermal management system into the cold zone. The device also includes a thermal management loop inlet placed in the reservoir to draw lubricant from the hot zone. The device also includes a machine loop inlet placed in the reservoir to draw lubricant from the cold zone.

The one or more embodiments also provide for a reciprocating pump system. The reciprocating pump system includes a reciprocating pump and a thermal management system. The reciprocating pump system also includes a dual loop lubrication system including a machine loop connected to the reciprocating pump and a thermal management loop connected to the thermal management system. The reciprocating pump system also includes a reservoir in fluid communication with the machine loop and the thermal management loop, the reservoir configured to contain a lubricant. The reciprocating pump system also includes one or more sets of baffles disposed in the reservoir. The one or more sets of baffles separate the reservoir into a hot zone and a cold zone. The one or more sets of baffles permit at least some flow of the lubricant between the hot zone and the cold zone. The reciprocating pump system also includes a machine loop drain connected to the machine loop, placed in the reservoir to drain lubricant returning from the reciprocating pump into the hot zone. The reciprocating pump system also includes a thermal management loop drain connected to the thermal management loop, placed in the reservoir to drain lubricant returning from the thermal management system into the cold zone. The reciprocating pump system also includes a thermal management loop inlet connected to the thermal management loop, placed in the reservoir to draw lubricant from the hot zone. The reciprocating pump system also includes a machine loop inlet connected to the machine loop, placed in the reservoir to draw lubricant from the cold zone.

The one or more embodiments also provide for a method. The method includes draining a lubricant from a machine loop into a hot zone of a reservoir. The method also includes draining the lubricant from a thermal management loop into a cold zone of the reservoir. The hot zone and the cold zone of the reservoir are separated by one or more sets of baffles that permit at least some flow of the lubricant between the hot zone and the cold zone. The method also includes drawing the lubricant from the hot zone into the thermal management loop. The method also includes drawing the lubricant from the cold zone into the machine loop.

Other aspects will be apparent from the following description and the appended claims.

BRIEF DESCRIPTION OF DRAWINGS

Like elements in the various figures are denoted by like reference numerals for consistency.

DETAILED DESCRIPTION

Figure 1:
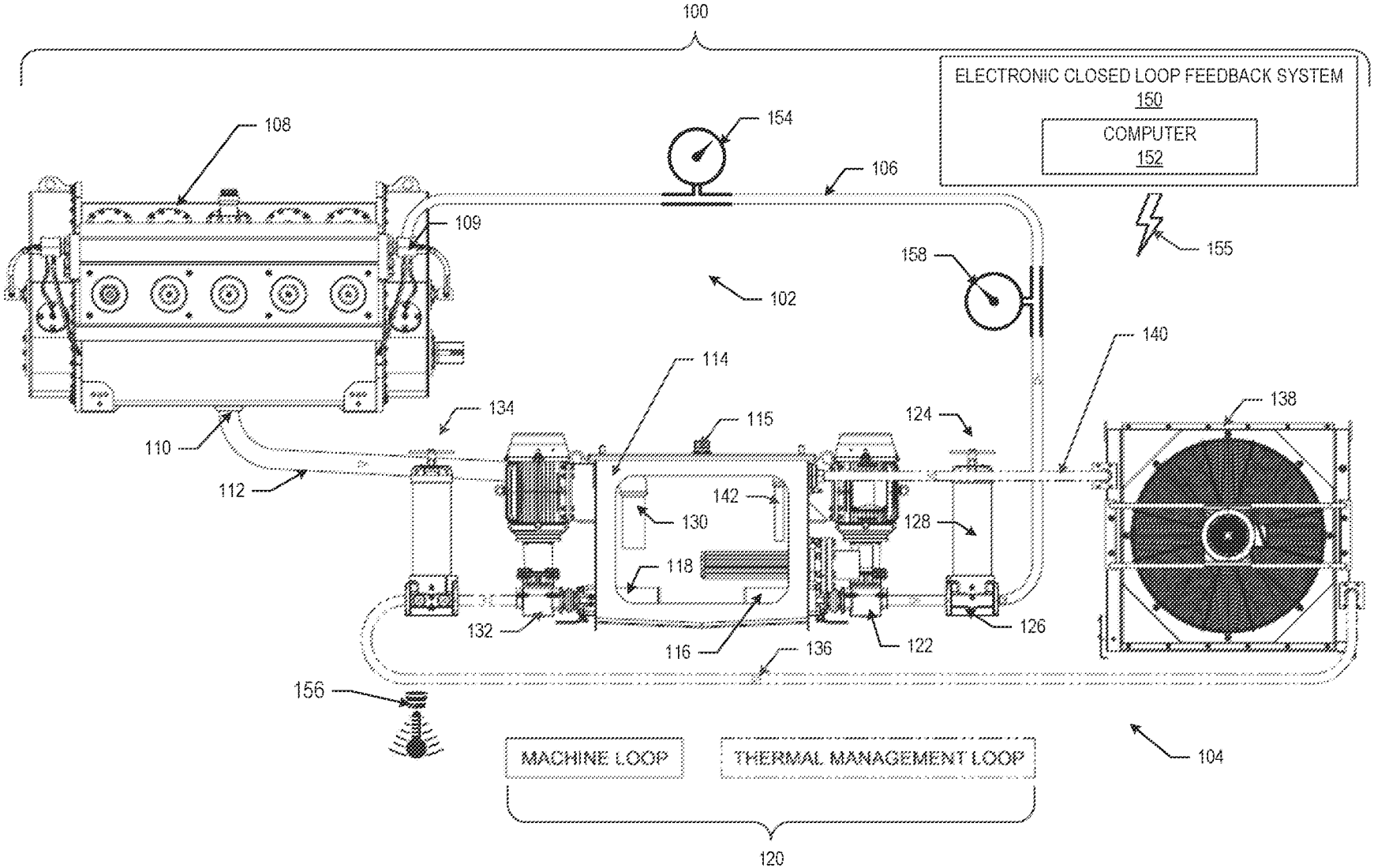
FIG. 1 shows a dual loop lubrication system, in accordance with one or more embodiments.

In general, the one or more embodiments are directed to a lubrication pressure and thermal management system split into two separate fluid loops. The lubrication pressure and thermal management system manages the lubrication pressure and temperature for a machine.

A machine loop is connected to the machine and a thermal management loop is connected to a temperature regulation system. Lubricant in the machine loop is at an elevated temperature and pressure relative to the environment of the machine. Lubricant in the thermal management loop is maintained at a lower temperature and pressure relative to the lubricant in the machine loop. A single reservoir holding the lubricant serves as both a source and a drain for both of the two loops.

Some machines are lubricated using a lubricant that is maintained at an elevated temperature and at an elevated pressure, relative to the environment surrounding the machine. Thus, a lubrication system, either external or internal to the machine, may be used to maintain a predetermined range of pressures and a predetermined range of temperatures of the lubricant as the lubricant flows into, through, and out of the machine. The lubrication system may be a single loop lubrication system, as mentioned above.

However, the lubrication system also may be the improved dual loop system described herein.

Some temperature regulation systems desirably maintain the lubricant at a lower temperature or at a lower pressure, relative to the predetermined range of temperatures or pressures set for the machine being lubricated. Forcing lubricant at the elevated pressure or temperature from the machine directly into the temperature regulation system, or vice versa, may cause undue wear or damage to the temperature regulation system, the machine, or both.

As a specific example, the one or more embodiments may be useful with respect to regulating lubricant pressure and temperature in a machine that is a reciprocating pump or a fracking pump. The operating pressure of the reciprocating or fracking pump is higher than atmospheric pressure, and thus is referred to as "high" pressure.

A reciprocating pump may be described as two coupled components: A power end and a fluid end. The power end converts rotary motion to linear motion. A dedicated lubrication system is used to maintain pre-determined engineering tolerances over a range of pressures and temperatures at which a lubricant (e.g., oil) is maintained within the power end. If the lubricant temperature and/or pressure becomes out of the engineering tolerances, then the reciprocating pump may be subject to costly damage or undue wear.

The fluid end converts linear motion to positive fluid displacement. The fluid end lubrication system may be an open end system that does not cycle lubricant. Instead, the lubricant that drains from the fluid end may collect in a pan to be disposed of or recycled.

The one or more embodiments address these and other issues by using a dual loop lubrication system. The dual loop system of the one or more embodiments circulates pressurized lubricant through the machine (e.g., through the power end of a reciprocating pump), while concurrently maintaining desired temperature and pressure ranges for the lubricant outside the machine. In a specific example, the thermal management loop is used to maintain lubricant at a lower temperature or pressure, whereas the machine loop is used to maintain lubricant at a higher pressure or temperature. The one or more embodiments also include a single reservoir shared between the two loops.

Attention is now turned to definitions of terms. Two components are in direct fluid communication when the fluid flows directly between the two components. For example, a pipe may be considered in direct communication with a valve when the fluid is moveable directly between the pipe and the valve. Two components are in indirect fluid communication when two components are in the same loop, but intervening components exist between the two components in question. For example, an inlet pipe conveys fluid into a machine and an outlet pipe conveys the fluid from out of the machine and into the outlet pipe. The inlet pipe and the outlet pipe may be considered to be in indirect fluid communication because intervening components within the machine are in the flow path of the lubricant.

As defined herein, and as described more fully below, a reservoir of lubricant is not considered part of a loop even if some components of the loop are in direct or indirect fluid communication with the reservoir. Instead, as used herein, a reservoir is deemed to be a source of fluid (e.g., the lubricant) for a loop and a drain for the fluid (e.g. the lubricant) for a loop. Thus, the two loops described herein are not in fluid communication with each other, except in the sense that the two loops share a common source and a common drain (i.e. the two loops share a common reservoir). The two loops are defined as not being in fluid communication with each other in order to make clear that various components or lines within one of the loops may be in direct or indirect fluid communication and share the same lubricant pressure within a common loop, but also to be clear that the two loops may be at different lubricant pressures.

The term "separate" is used herein to refer to components that are not connected. Thus, two lines that are "separate" are in neither direct nor indirect fluid communication with each other. For example, the two loops described herein are "separate," as described above, even if the two loops share the same source and drain (i.e., the common reservoir). The term "separate" may also refer to other components that are not connected (e.g., not in fluid communication with each other), as described below.

As defined herein the term "lubricant" automatically includes the term "coolant" or other fluids. Thus, the one or more embodiments may be used to maintain cooling systems that force a coolant through the machine, in addition to lubrication systems that force a lubricant through a machine or other systems that force other fluids through a machine. The term "lubricant" also includes any fluid that has multiple purposes in a system (e.g., a fluid that acts as both a lubricant and a coolant). The term "coolant" also contemplates fluids that are used to maintain a machine at an elevated temperature (i.e., the term "coolant" also contemplates the use of a heated fluid to increase the temperature of one or more components of the machine).

Attention is now turned to the figures. FIG. 1 shows a dual loop lubrication system, in accordance with one or more embodiments. The dual loop lubrication system (100) includes a machine loop (102) and a thermal management loop (104). The machine loop (102) and the thermal management loop (104) are separate from each other. As defined above, the term "separate" means that the two loops are not in fluid communication with each other. In other words, as defined above, the two loops are not in fluid communication with each other (either direct or indirect), except in the sense that the two loops share a common source and a common drain (i.e., the reservoir (114)).

The machine loop (102) includes a machine inlet line (106), a machine inlet (109), a machine (108), a machine outlet (110), and a machine drain line (112). As used herein a "line" is a pipe, channel, or other object or device for conveying a fluid from one location to another. A line may have many different shapes and configurations, and thus is not limited to a cylindrical pipe. The machine (108) may be a reciprocating pump, a mobile pump, a water pump, a sand pump, an oil pump, or any other type of machine that uses lubrication in some manner.

The pressure within the machine loop (102) may be at a high pressure, as defined above. In other words, the pressure of the lubricant being pumped from the first pump (122), through the machine inlet line (106), and through the machine (108) is at a high pressure.

The machine loop (102) is connected to a reservoir (114). The reservoir (114) is a device configured to contain lubricant. For example, the reservoir (114) may be a tank, a basin, a silo, etc. The reservoir (114) may have a variety of shapes and sizes. The pressure of the lubricant exiting the machine (108) may be at atmospheric pressure (i.e., once the lubricant leaves the machine (108), the lubricant is at atmospheric pressure).

The reservoir (114) receives lubricant from the machine loop (102) and from the thermal management loop (104). While the pressure of the lubricant in the reservoir (114) may be at atmospheric pressure generally, internal pressure could build or change within the reservoir (114) due to temperature changes in the lubricant (lubricant coming out of the machine (108) may be relatively hot) and due to lubricant levels rising or falling, expanding or compressing air inside the reservoir (114). Thus, the reservoir (114) may include a pressure equalizer (115). The pressure equalizer (115) is either a design aspect of the reservoir (114) that passively equalizes pressure within the reservoir (114), or a component which actively equalizes air pressure within the reservoir (114) with an ambient air pressure (e.g., the atmosphere).

An example of a pressure equalizer (115) that is passive is an open tank. In other words, a top of the reservoir (114) may be open to the air (or covered with a grate) in order that the pressure of the lubricant in the reservoir (114) may equalize with atmospheric pressure. Another example of a pressure equalizer (115) that is passive is one or more automatic pressure relief valves that, in direct response to pressure differences, open or close to equalize pressure within the reservoir (114) with an ambient pressure (e.g., atmospheric pressure). An example of a pressure equalizer (115) that is active may be a valve which is actively controlled to open or close in order to maintain a desire engineering tolerance for a pressure of the lubricant within the reservoir (114).

The reservoir (114) may include a first reservoir outlet (116) and a second reservoir outlet (118). Fluid flows from the first reservoir outlet (116) to the machine loop (102), and from the second reservoir outlet (118) to the thermal management loop (104).

In FIG. 1, the machine loop (102) may be identified by following the fluid lines drawn in solid lines, as shown by legend (120). The machine loop (102) may be traced from a first pump (122) that is in fluid communication with the first reservoir outlet (116). The first pump (122) may be a variety of different pumps suitable for pumping the lubricant. In an embodiment, the first pump (122) may be one or more of a speed-adjustable positive displacement pump, a motor driven fixed displacement pump, or some other type of pump.

The first pump (122) is configured to urge lubricant from the reservoir (114) into the machine inlet line (106) of the machine loop (102). The first pump (122) may be set to pressurize the lubricant to a first pre-determined range of pressures. The first pre-determined range of pressures is within a pre-determined engineering tolerance of lubricant pressures for which the machine (108) is designed. The first pre-determined range of pressures may be partially or fully outside of a pre-determined engineering tolerance of lubricant pressures for which the thermal management system (138) is designed.

Optionally, a first particle removal system (124) may be placed in fluid communication with the machine inlet line (106). The first particle removal system (124) is a filter that filters particles of one or more pre-determined size ranges from the lubricant as the lubricant advances along the machine loop (102). In an embodiment, the first particle removal system (124) may be placed at different locations along the machine inlet line (106) downstream of the first pump (122). The first particle removal system (124) may be placed elsewhere, but pressure drops at the suction side of the pump should be avoided in order to prevent cavitation and hence possibly damage to the pump.

The first particle removal system (124) may include sub-components. The sub-components of the first particle removal system (124) need not be located in direct communication with each other, but may be located in different locations of the machine loop (102). For example, the first particle removal system (124) may include a first strainer (126) and a first filter (128).

The first strainer (126) is configured to remove particles of a first predetermined size range from the lubricant. For example, the first strainer (126) may be configured to remove "larger" particles from the lubricant, with "larger" being defined as particles having sizes within the first pre-determined size range. The first strainer (126) may be located where shown in FIG. 1, but also could be located immediately after the first pump, or elsewhere along the machine inlet line (106).

The first filter (128) is configured to remove particles of a second predetermined size range from the lubricant in the reservoir. For example, the first filter (128) may be configured to remove "smaller" particles from the lubricant, with "smaller" being defined as particles having sizes within the second pre-determined size range. The first pre-determined size range is different than the second pre-determined size range, though there may be an overlap between the two size ranges in some cases. In an embodiment, the second predetermined size range is less than the first predetermined size range, in which case the terms "larger" and "smaller" refer to the relative size differences of particles being filtered by the first strainer (126) and the first filter (128), respectively. The first filter (128) may be located where shown in FIG. 1, but also could be located anywhere after the first strainer (126) along the machine inlet line (106). Theoretically, the first filter (128) could be located before the first strainer (126) along the machine inlet line (106), though it may be more advantageous to first strain the larger particles with the first strainer (126) and then subsequently filter the smaller particles with the first filter (128).

After the first particle removal system (124), relative to the direction of the flow of the lubricant, the lubricant passes through one or more additional segments of the machine inlet line (106). The machine inlet line (106) terminates at the machine inlet (109). There might be more than one inlet at which the machine inlet (109) terminates. One or more junctions in the machine inlet (109) may be located such that the junctions are in direct communication with the inlets, with all other components being upstream of the first junction.

In any case, lubricant flows from the reservoir (114), through the first pump (122), through the first particle removal system (124), through one or more segments of the machine inlet line (106), and then enters the machine inlet (109). The lubricant then enters the machine (108) and lubricates one or more components of the machine (108).

The lubricant then exits the machine (108) at the machine outlet (110). The lubricant then passes into one or more segments of the machine drain line (112). The pressure of the lubricant at the machine outlet (110) is typically at or near atmospheric pressure, due to pressure losses within the machine (108). However, in some embodiments, the lubricant pressure at the machine outlet (110) and the machine drain line (112) may be higher or lower, depending on the configuration of the machine (108).

The temperature of the lubricant at the machine outlet (110) and the machine drain line (112) may be higher than the temperature of the lubricant in the machine inlet line (106). For example, friction inside the machine (108) may cause the lubricant at the machine outlet (110) and the machine drain line (112) to increase in temperature. However, in other embodiments, the temperature of the lubricant at the machine outlet (110) and the machine drain line (112) may be the same as or lower than the temperature of the lubricant at the machine inlet line (106). For example, the machine (108) may act to refrigerate or warm the lubricant within the machine (108). In many cases, the temperature of the lubricant at the machine outlet (110) and the machine drain line (112) is elevated relative to the temperature of the lubricant in the machine inlet line (106).

The machine drain line (112) drains into the reservoir (114) at first drain (130). Thus, the machine drain line (112) is drawn as being behind other components adjacent to the reservoir (114). In an embodiment, the first drain (130) is located above the second reservoir outlet (118), relative to the direction of gravity, and on an opposite side of the reservoir (114) relative to the first reservoir outlet (116). However, the location of the first drain (130) may vary. For example, the first drain (130) may be located at other positions along the length and height of the reservoir (114), including but not limited to the same side of the reservoir (114) at which the first reservoir outlet (116) is located.

After the lubricant drains from the first drain (130), the pressure of the lubricant equalizes with atmospheric pressure. For example, a top of the reservoir (114) may be exposed to air. In some cases, the top of the reservoir (114) may be closed, in which case one or more pressure valves may be used to equalize the pressure of a gas disposed over a lubricant surface line within the reservoir (114). Because, in many cases, the pressure of the lubricant draining through the first drain (130) is elevated relative to atmospheric pressure, the direct or indirect exposure to atmospheric pressure lowers the pressure of the lubricant after exiting the first drain (130).

Attention is now turned to the thermal management loop (104). Beginning at the reservoir (114), the thermal management loop (104) includes a second pump (132) that connects to the second reservoir outlet (118) of the reservoir (114). The second pump (132) may be a variety of different pumps suitable for pumping the lubricant, but in an embodiment, the second pump (132) may be one or more of a speed-adjustable positive displacement pump and a motor-driven fixed displacement pump.

The second pump (132) pumps the lubricant in the reservoir at a second predetermined range of pressures. The second predetermined range of pressures is less than the first predetermined range of pressures at which the lubricant is pumped in the machine loop (102). The second predetermined range of pressures is selected to be within an engineering tolerance of lubricant pressures for the thermal management system (138). The second pre-determined range of pressures may be partially or fully outside of a pre-determined engineering tolerance of lubricant pressures for which the machine (108) is designed.

Optionally, a second particle removal system (134) may be disposed along the thermal management inlet line (136). The second particle removal system (134) may also include a strainer or a filter, or both, as described with respect to the first pump (122).

After the second particle removal system (134), relative to the direction of the flow of the lubricant, the lubricant passes through one or more additional segments of the thermal management inlet line (136). The thermal management inlet line (136) terminates at the thermal management system (138). Thus, lubricant flows from the reservoir (114), through the second pump (132), through the second particle removal system (134), through one or more segments of the thermal management inlet line (136), and then enters the thermal management system (138).

In turn, the thermal management system (138) adjusts the temperature of the lubricant. In some embodiments, the thermal management system (138) may be one or more heat exchangers arranged in parallel or series or a combination of both, allowing efficient heat transfer from the lubricant to a solid body or a fluid, the fluid being liquid or gaseous, either of which can be at lower temperature than the lubricant. The heat exchanger may offer means of controlling the rate of heat exchange, in one embodiment this can be achieved by controlling the fan speed of a forced convection air to liquid cooler. The second pump (132) and the fan speed of the thermal management system (138) may be controlled independently, relative to other components of the dual loop lubrication system (100), with an electronic closed loop feedback system (150), described below.

While the thermal management system (138) has no communication with the machine (108), the thermal management system (138) can lower the temperature of the lubricant in the reservoir (114). As a result, lubricant pumped from the reservoir (114) and back to the machine (108) will be at a lower temperature than the lubricant exiting the machine (108). In this manner, a desired lubricant temperature inside the machine (108) may be maintained.

In any case, the thermal management system (138) may be used to lower or otherwise adjust a temperature of the lubricant as the lubricant passes through the thermal management system (138), without exposing the components of the thermal management loop (104) to high pressures and without risking cavitation at the first pump (122) or the second pump (132).

In other embodiments, such as at cold weather facilities, the thermal management system (138) also may include one or more heaters. In other words, the thermal management system (138) may be used to elevate the temperature of the lubricant relative to the temperature of the lubricant passing through the thermal management loop (104). However, in other embodiments, heaters may be placed within the reservoir (114) or somewhere within the machine loop (102). In any case, the lubricant passes from the thermal management system (138) to the thermal management drain line (140).

The thermal management drain line (140) drains into the reservoir (114) at second drain (142). Thus, the thermal management drain line (140) is drawn in FIG. 1 as being in front of other components adjacent to the reservoir (114) (e.g., the first pump (122) and the first particle removal system (124)). In an embodiment, the second drain (142) is located above the first reservoir outlet (116), relative to the direction of gravity, and on an opposite side of the reservoir (114) relative to the second reservoir outlet (118). However, the location of the second drain (142) may vary. For example, the second drain (142) may be located at other positions along the length and height of the reservoir (114), including but not limited to the same side of the reservoir (114) at which the second reservoir outlet (118) is located.

By using the dual loop lubrication system (100), the flow rate and pressure generated by the first pump (122) may be controlled independently from the flow rate and pressure generated by the second pump (132). Thus, the two loops may be independently regulated.

In an embodiment, the dual loop system shown in FIG. 1 may include an electronic closed loop feedback system (150). The electronic closed loop feedback system (150) is one or more sensors in wired or wireless communication with one or more components of the dual loop system shown in FIG. 1, as shown by communication symbol (155). The wired or wireless communication system may include radios, wires, infrared signal equipment, internet communications, etc. The electronic closed loop feedback system (150) also includes a computer (152) or an application specific integration circuit configured to process data from the one or more sensors according to rules and then control the one or more components of the dual loop system based on outputs of the rules.

For example, the electronic closed loop feedback system may be used to control the desired lubrication pressure for the machine (108). In this case, a pressure sensor (154) may be connected to the machine inlet line (106), for example. The pressure sensor (154) generates a signal that is transmitted to the computer (152) of the electronic closed loop feedback system (150). The signal indicates the pressure value measured by the pressure sensor (154). When the pressure value falls below a lower pressure threshold, as determined by the computer (152), then the computer (152) sends a control signal to the first pump (122). The control signal orders the first pump (122) to operate at a higher setting so that the pressure in the machine inlet line (106) increases. A similar process may be implemented in order to cause the first pump (122) to lower a lubricant pressure in the machine inlet line (106) when the pressure sensor (154) signal indicates that the pressure in the machine inlet line (106) rises above a higher pressure threshold. Thus, a closed loop feedback system is established to regulate a range of lubricant pressures within the machine inlet line (106).

In another example, during warm-up, the electronic closed loop feedback system (150) may be used to control a desired lubricant flow rate in the thermal management loop (104) in order to keep the pressure within the thermal management loop (104) at a predetermined level. A thermometer (156) connected to the thermal management inlet line (136) connected to the thermal management loop (104) may measure a temperature of the lubricant in the thermal management loop (104). A temperature signal indicating the temperature value is transmitted to the computer (152), which compares the temperature value to a reference temperature. When the temperature value fails to meet the reference temperature, the electronic closed loop feedback system (150) may then use a heater (see FIG. 3) in the thermal management loop (104) to adjust the temperature of the lubricant before the lubricant is pumped into the thermal management system (138).

In still another example, the electronic closed loop feedback system (150) may be used to control a desired lubricant flow rate in the thermal management loop (104) based on a direct measurement of the flow rate in one or more portions of the dual loop lubrication system (100). For example, a flow rate sensor (158) may be connected to the machine inlet line (106). The flow rate sensor (158) measures a flow rate of the lubricant within the machine inlet line (106). If the flow rate fails to meet a threshold flow rate, then the electronic closed loop feedback system (150) can adjust operation of one or more pumps (e.g., the first pump (122)) to increase or decrease the flow rate as desired. Note that the flow rate sensor (158) may be located anywhere in or along the dual loop lubrication system (e.g., other lines, the machine (108), the thermal management system (138), etc.). Multiple flow rate sensors also may be present, in which case a combination of sensor readings may be used to control one or more flow rates of the lubricant in one or more different locations within the dual loop lubrication system (100).

Figure 3:
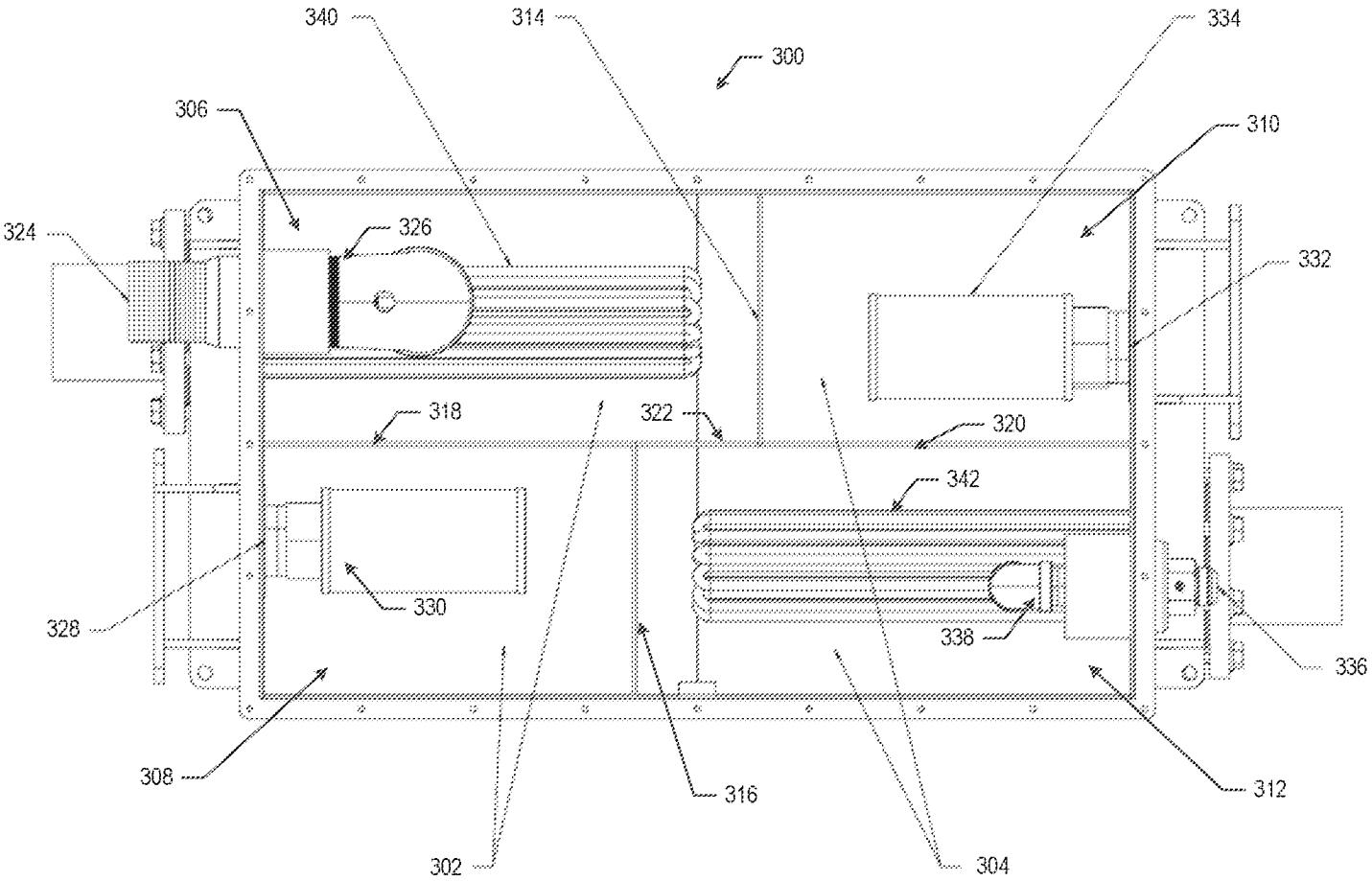
FIG. 3, FIG. 4, FIG. 5, and FIG. 6 show views of an example reservoir for use in the dual loop lubrication system of FIG. 1 or FIG. 2, in accordance with one or more embodiments.

While the dual loop lubrication system (100) shown in FIG. 1 shows only one pressure sensor (154) and one thermometer (156), many other sensors may be present at various locations with respect to either loop or the reservoir (114). The sensors may also be of different types (e.g., flow rate sensors, viscosity sensors, oil quality sensors, etc.). Still further, the electronic closed loop feedback system (150) may use the data signaled from the various sensors to control other components of the dual loop lubrication system (100), or components that may be added to the reservoir (114) (e.g., a heater disposed in the reservoir (114), as shown in FIG. 3).

Thus, combinations of sensor data may be used to control a variety of different operations of the dual loop lubrication system (100), either collectively or individually. For example, the one or more embodiments contemplate monitoring, using at least one sensor, at least one of a pressure and a temperature of the lubricant in at least one of the first line system, the second line system, and the reservoir. In this case, the one or more embodiments also contemplate changing operation of a device disposed in the reservoir, the first line system, or the second line system in response to data received from the at least one sensor, as described above.

In still another example, optional pressure relief valves or other types of pressure regulators may be used to control the individual maximum or minimum allowable pressure for either the machine loop (102) or the thermal management loop (104). Accordingly, the pressure in each loop may be maintained at a desired range of individualized pressure tolerances. Thus, the one or more embodiments are not necessarily limited by the examples given above.

Figure 2:
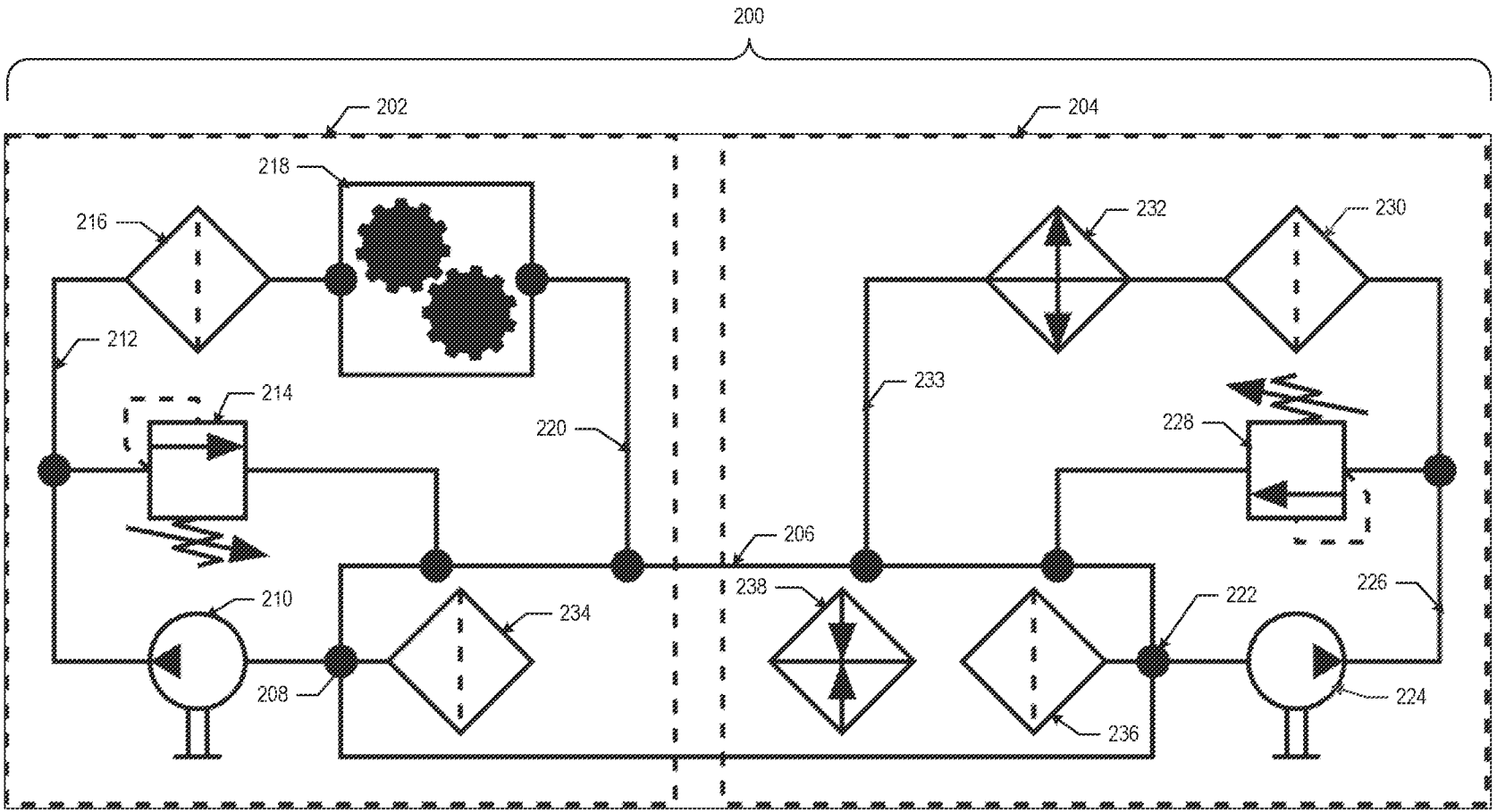
FIG. 2 shows the dual loop lubrication system fluid circuit, in accordance with one or more embodiments.

FIG. 2 shows the dual loop lubrication system fluid circuit, in accordance with one or more embodiments. The dual loop lubrication system (200) shown in FIG. 2 is a circuit representation of the specific example of the dual loop lubrication system (100) shown in FIG. 1. Thus, FIG. 2 shows that the one or more embodiments contemplate more than the specific arrangement of components shown in the dual loop lubrication system (100) of FIG. 1. The solid lines shown in FIG. 2 are "lines", as defined above (i.e., pipes or other means for conveying a fluid such as a lubricant).

The dual loop lubrication system (200) includes a primary loop (202) and a secondary loop (204). The primary loop (202) may be the machine loop (102) of FIG. 1. The secondary loop (204) may be the thermal management loop (104) of FIG. 1. The reservoir (206) may be the reservoir (114) of FIG. 1.

The primary loop (202) begins at a first reservoir outlet (208) from the reservoir (206). A machine loop pump (210) pumps lubricant from the reservoir (206) into a machine line (212) at an elevated pressure that meets a pressure engineering tolerance for the machine (218). Optionally, a first pressure release valve (214) may allow lubricant to escape back into the reservoir (206) in the event of over-pressurization of the lubricant within the machine line (212). Optionally, a first filter (216) may filter the lubricant within the machine line (212).

The lubricant then flows into the machine (218), possibly at a high pressure. Finally, the lubricant flows out of the machine (218), through a machine loop drain line (220), and back into the reservoir (206). Lubricant in the machine loop drain line (220) may be at a lower (e.g. atmospheric) pressure, or otherwise less than the pressure in the machine line (212), due to pressure losses in the machine (218).

The secondary loop (204) begins at a second reservoir outlet (222). A thermal management loop pump (224) pumps the lubricant from the reservoir (206) and into a thermal management line (226). The pump may maintain at atmospheric pressure within the thermal management line (226), but, in any case, maintains the lubricant pressure within the thermal management line (226) within an engineering tolerance of a heat exchange system (232).

Optionally, a second pressure release valve (228) may allow lubricant to escape back into the reservoir (206) in the event of over-pressurization of the lubricant within the thermal management line (226). Optionally, a second filter (230) may filter the lubricant within the thermal management line (226).

The lubricant then flows into the heat exchange system (232). In turn, the heat exchange system (232) cools the lubricant or otherwise regulates the temperature of the lubricant, as described above with respect to FIG. 1. Finally, the lubricant flows out of the heat exchange system (232), through a thermal management loop drain line (233), and back into the reservoir (206).

Attention is returned to the reservoir (206). The reservoir (206) may include additional features. For example, the reservoir (206) may include a first strainer (234). The first strainer (234) may strain particles of a first predetermined size range that may be present in the reservoir (206), thereby preventing such particles from entering the machine loop pump (210) or the machine line (212). Likewise, the reservoir (206) may include a second strainer (236) which performs a similar function with respect to the thermal management loop pump (224) and the thermal management line (226).

The reservoir (206) may also include one or more heaters, indicated by heater (238). The heater (238) may heat the lubricant within the reservoir (206).

The dual loop lubrication system (200) shown in FIG. 2 may be further varied. For example, additional pumps, filters, strainers, heaters, gauges, sensors, etc. may be added. Furthermore, additional loops (e.g. multiple thermal management loops and multiple machine loops) may also be present, sharing a single reservoir. Multiple reservoirs in fluid communication with each other may be present in some cases. Thus, the one or more embodiments are not necessarily limited to the example of FIG. 2.

The pressure drop and temperature influence of components in the dual loop lubrication system (200) may be monitored by placing pressure and temperature sensors in selected locations (e.g. on any of the components shown in FIG. 1 or FIG. 2, or along the lines). The sensors are controlled by an electronic control unit that returns the current state of the lubrication circuit and the components of the lubrication circuit. This data, in conjunction with previously acquired benchmark data, can provide a state of health indicator for each component. In this manner, system health and potential system failure may be predicted before an event occurs. The electronic control unit can request a shutdown during operation if the machinery component is operated in an operating state that is outside a selected engineering tolerance.

Thus, the one or more embodiments may provide for a sensor connected to at least one of the first loop and the second loop. The sensor may be configured to measure at least one property of the lubricant. A control mechanism may be configured to regulate, based on at least one property of the lubricant, at least one of the machine, the first pressure, the second pressure, and the temperature. The property of the lubricant may be pressure, temperature, viscosity, flow rate, purity (i.e., cleanliness with respect to particle contamination), and combinations thereof.

In a specific example, the one or more embodiments may include a first pressure sensor connected to the first loop. The first pressure sensor may be connected to a line or any of the components of the first loop. The first pressure sensor is configured to measure a first pressure of the first line. In addition, a first temperature sensor may be connected to the first loop. The first temperature sensor may be configured to measure a first loop temperature of the lubricant within the first loop. Similarly, a second pressure sensor may be connected to the second loop and configured to measure the second pressure of the second line. Likewise, a second temperature sensor may be connected to the second loop and configured to measure a second loop temperature of the lubricant within the second loop. In this case, a control mechanism is configured to regulate at least one of: the operation of the machine, the first pressure, the second pressure, the first loop temperature, and the second loop temperature. The control mechanism may regulate one or more properties of the lubricant based on data from at least one of the first pressure sensor, the second pressure sensor, the first temperature sensor, and the second temperature sensor. For example, if the data is a measurement of pressure at an inlet, and the pressure is outside of a desired engineering tolerance, then the control mechanism may be used to change the operation of one or more pumps, pressure relief valves, etc. In another example, if the viscosity of the lubricant rises above a threshold, then the temperature of the lubricant may be increased in order to decrease the viscosity of the lubricant below the threshold.

A useful feature of the one or more embodiments is that no pressure-sensitive components (e.g., radiators) are located in the high-pressure loop. As a result, higher lubrication pressure is possible for the primary loop (202), relative to lubrication pressure in the secondary loop (204). As a result, the lifetime of the power end (i.e., the machine being lubricated) may be extended.

The dual loop lubrication circuit of the one or more embodiments has several other useful features. For example, thermal conditioning of the lubricant is provided without the need to circulate lubricant through the machinery component. As a result, the lubrication inside the machine can function at or about the ideal physical properties of the lubricant before the machine has reached operating temperature.

In another example, when utilizing individual pumps, lubrication and cooling performance can be controlled independently. As a result, the need for a trade-off required when selecting a single pressure shared across multiple components is reduced. Furthermore, possibly concurrently, the low end of the single pressure range may be undesirably high for the thermal management end. The dual loop system of the one or more embodiments address the above concerns by providing for individually selected pressures for the lubricant for each of the power component and the thermal management component.

In still another example, the one or more embodiments provide for managing temperature by adjusting the secondary pump speed or cooler fan speed. As a result, the one or more embodiments eliminate or reduce the need for a thermal diverting valve. Because a thermal diverting valve may be a common source of system failure, the one or more embodiments increase the durability of a system by eliminating or reducing the need for failure-prone components.

In yet another example, premature component failures can be detected through continuous monitoring in various different parts in each loop of the dual loop system of the one or more embodiments. Continuous monitoring may prevent a complete failure of the machinery component.

The one or more embodiments described with respect to FIG. 1 and FIG. 2 may be varied. For example, more than two loops may be present. For example, it is possible that three or more loops share a common reservoir. In a more specific example, multiple thermal management loops may be provided for a single reservoir. In still another example, additional loops (or a replacement for the thermal management loop (104)) may be used to perform other functions for liquid pumped between different systems having different pressure, temperature, or other parameter requirements. Thus, the one or more embodiments are not necessarily limited to the examples described above.

FIG. 3, FIG. 4, FIG. 5, and FIG. 6 show views of an example reservoir for use in the dual loop lubrication system of FIG. 1 or FIG. 2, in accordance with one or more embodiments. Thus, the reservoir (300) shown in FIG. 3 through FIG. 6 may be the reservoir (114) shown in FIG. 1 or the reservoir (206) shown in FIG. 2. FIG. 3 through FIG. 6 show different views of one example reservoir. Therefore, FIG. 3 through FIG. 6 share common reference numerals having common definitions. The reservoir (300) shown in FIG. 3 through FIG. 6 is configured to contain a lubricant (for example, the reservoir (300) may be surrounded at least by walls and a bottom in order to hold a lubrication fluid).

As indicated above with respect to FIG. 1 and FIG. 2, a dual loop lubrication system may use a common reservoir that takes the form of a common tank. The common tank may be open to the air or have one or more pressure relief valves that allow the pressure above the surface of the lubricant in the tank to equalize with air pressure.

However, in a dual loop lubrication system using a shared single-tank reservoir, as described above in FIG. 1 and FIG. 2, the return flow of lubricant from both loops (i.e. the lubricant entering the reservoir from the drains of both loops) mixes inside the reservoir in an uncontrolled manner Uncontrolled mixing may result in sub-optimal heat exchange between warmer and colder regions of lubricant inside the reservoir. As a result, the lubricant that enters at the inlet to the thermal management loop is at a reduced temperature, relative to the temperature of the lubricant entering the reservoir from the machine line inlet. The temperature of the lubricant entering the reservoir from the machine line may be referred to as a reference temperature. The reference temperature may be the temperature of the lubricant exiting the machine loop. The reference temperature also may be the temperature the lubricant would have been at the inlet to the thermal management loop, had more complete mixing occurred between lubricant entering the reservoir at the drain end of the thermal management loop and lubricant entering the reservoir at the drain end of the machine loop.

The reduction in temperature of the lubricant entering the thermal management loop reduces the cooling efficiency of the overall thermal management loop. The reason for the loss of efficiency is that the rate of heat exchange between two masses depends proportionally on the temperature difference between the two masses. The higher the temperature difference between two thermally linked masses, the exponentially higher the rate of heat exchange between the thermally linked masses. The rate of heat exchange between two thermally linked masses depends on other factors as well, including the specific heat of the masses, the relative amounts of masses, the amount of contact between the two masses, and other factors. Thus, from a thermal exchange perspective, it would be desirable that the relatively hot lubricant draining from the machine loop be drawn directly into the thermal management loop.

One method of addressing the above issue would be to use a mixer in the reservoir. The mixer would ensure that the lubricant draining from the thermal management loop better mixes with lubricant draining from the machine loop. The result of mixing the lubricant in the reservoir would raise the temperature of the lubricant entering the thermal management loop, relative to the use of a simple tank as described above. Raising the temperature of the lubricant entering the thermal management loop, in turn, improves the efficiency of thermal exchange between the lubricant in the thermal management loop and the receiving coolant (e.g., air or a coolant).

However, mixing of the two temperature regions in the reservoir has two issues: 1) the machine loop draws lubricant that is warmer than ideal, resulting in higher machine temperatures and 2) the thermal management loop line draws lubricant that is colder than ideal resulting in reduced heat exchanger efficiency. Thus, a mixer may not be suitable for all applications.

The reservoir of FIG. 3 through FIG. 6 addresses the above issues, along with other issues. Specifically, FIG. 3 through FIG. 6 show an improved reservoir that increases the temperature of the lubricant that enters the thermal management loop. Again, the term "increase" is relative to the temperature that the lubricant would have had entering the thermal monument loop if a single tank reservoir had been used. As used herein, a "single tank reservoir" is a reservoir that substantially permits fluid to flow throughout the tank (e.g., without the baffles shown in FIG. 3 through FIG. 6 or some other sets of baffles that at least partially inhibit the flow of lubricant within the tank). Stated differently, the improved reservoir (300) improves the overall thermal exchange efficiency of the overall dual loop lubrication system, relative to the thermal exchange efficiency of a dual loop system that uses a single tank reservoir. Additionally, because the reservoir temperature is, on average, lower compared to the machine return temperature than in a traditional single loop system, the negative effects of a catastrophic cooler failure (e.g. bursting) are mitigated. For example, only the thermal management loop is affected, which can be immediately shut down while the machine loop continues to operate. Because the reservoir temperature is colder than the machine return temperature, this feature gives an operator more time to safely shut down machine and the machine loop.

In particular, the reservoir (300) of FIG. 3 through FIG. 6 uses baffles with differing geometries to increase the temperature of the lubricant entering the thermal management loop while maintaining the pressure engineering tolerance of the lubricant entering the thermal management loop. The baffles may have cutouts on their lower edges, allowing for restricted flow and easy draining of the reservoir. The "lower" edge of the baffles is defined relative to a depth of the reservoir (300). Thus, the "lower" edge of the baffles is closer to the bottom of the reservoir (300), relative to an "upper" edge of the baffles that is closer to the top of the reservoir (300). The "top" and the 'bottom" of the reservoir (300) are defined in relation to a direction of gravity.

The reservoir (300) has two temperature zones, a hot zone, and a cold zone. The term "hot" refers to the temperature of the lubricant draining from the machine loop into the reservoir. The term "cold" refers to the temperature of the lubricant draining from the thermal management loop into the reservoir. The flow between the hot zone and the cold zone is possible, but restricted by baffles. Each zone is split by a lower baffle into a "return" section and a "suction" section. Thus, as described more fully below, the hot zone is divided into a primary suction return section (i.e., a thermal management loop inlet of the reservoir in FIG. 1) and a secondary suction section (i.e., a thermal management loop outlet of the reservoir in FIG. 1). The cold zone is divided into a primary suction section (i.e., a machine loop inlet of the reservoir in FIG. 1) and a secondary return section (i.e., a machine loop outlet of the reservoir in FIG. 1).

Lubricant returning from the machine loop enters the hot zone below the upper edges of sets of baffles that separates the hot zone and the cold zone and further separates the sections mentioned above. Lubricant flows over the sets of baffles, thereby increasing deaeration (increasing the amount of air removed from a fluid). Lubricant is drawn through a thermal management loop inlet in the hot zone, which is located low in the reservoir, and thereby drawn into the thermal management loop.

The flow design for the cold zone is analogous, with lubricant draining from the thermal management loop into the cold zone of the reservoir (300), passing the sets of baffles (e.g., fourth baffle (320)), drawn through a machine loop inlet in the cold zone, and thence drawn into the machine loop. Thus, not only is the temperature of the lubricant increased when entering the thermal management loop, but the temperature of the lubricant is decreased when entering the machine loop, relative to a single tank dual loop system. However, the different pressure engineering tolerances for two different loops are also maintained.

For cold weather environments, the reservoir (300) may also incorporate one or more immersion heaters. For example, two immersion heaters may be used, with both immersion heaters located in the "return" sections of the reservoir (300). In situations where relatively high lubricant viscosity prevents achieving significant flow rates through both loops, the immersion heaters can heat up the lubricant, reducing the viscosity of the lubricant. In these situations, convection currents dominate the flow pattern inside the reservoir. The design of the baffles may be adjusted to allow for circulation in this convection state, while at the same time restricting flow patterns during regular operation.

Attention is now returned to FIG. 3. Initially, portions of the reservoir are described, with definitions of terms used to describe the portions provided further below. The reservoir (300) may be considered divided into two zones, each with two sections (i.e., there are four zones in all). In particular, the reservoir (300) is divided into a hot zone (302) and a cold zone (304). The hot zone (302) is divided into a primary return section (306) and a secondary suction section (308). The cold zone (304) is divided into a primary suction section (310) and a secondary return section (312). Baffles, described in more detail below, separate the sections and the zones.

Attention is now turned to definitions used with respect to the description of zones and sections, above. A "zone" is an internal portion of the reservoir (300) in which lubricant is at either an elevated or a lower temperature, relative to the other zone. A "section" is an internal portion of the reservoir (300) within a "zone" that connects to a different portion of the dual loop system shown in FIG. 1 or FIG. 2, relative to the other "section" within the same zone.

The term "hot" refers to a temperature of the lubricant that is closer to the temperature of the lubricant entering the reservoir (300) from the machine loop drain (not shown in FIG. 3), relative to the temperature of the lubricant entering the reservoir (300) from the thermal management loop. The term "cold" refers to a temperature of the lubricant that is closer to the temperature of the lubricant entering the reservoir (300) from the thermal management loop drain piping (338), relative to the temperature of the lubricant entering the reservoir (300) from the machine loop.

As indicated above, the zones and the sections are separated by baffles. Four sets of baffles are shown in FIG. 3, including a first baffle (314), a second baffle (316), a third baffle (318), and a fourth baffle (320). In an embodiment, the third baffle (318) and the fourth baffle (320) are a single baffle system that extends the length of the reservoir (300). However, the first baffle (314) and the second baffle (316) may form a middle baffle portion (322), with the third baffle (318) and the fourth baffle (320) extending from the walls of the reservoir (300) to the first baffle (314) and the second baffle (316), respectively.

Figure 4:
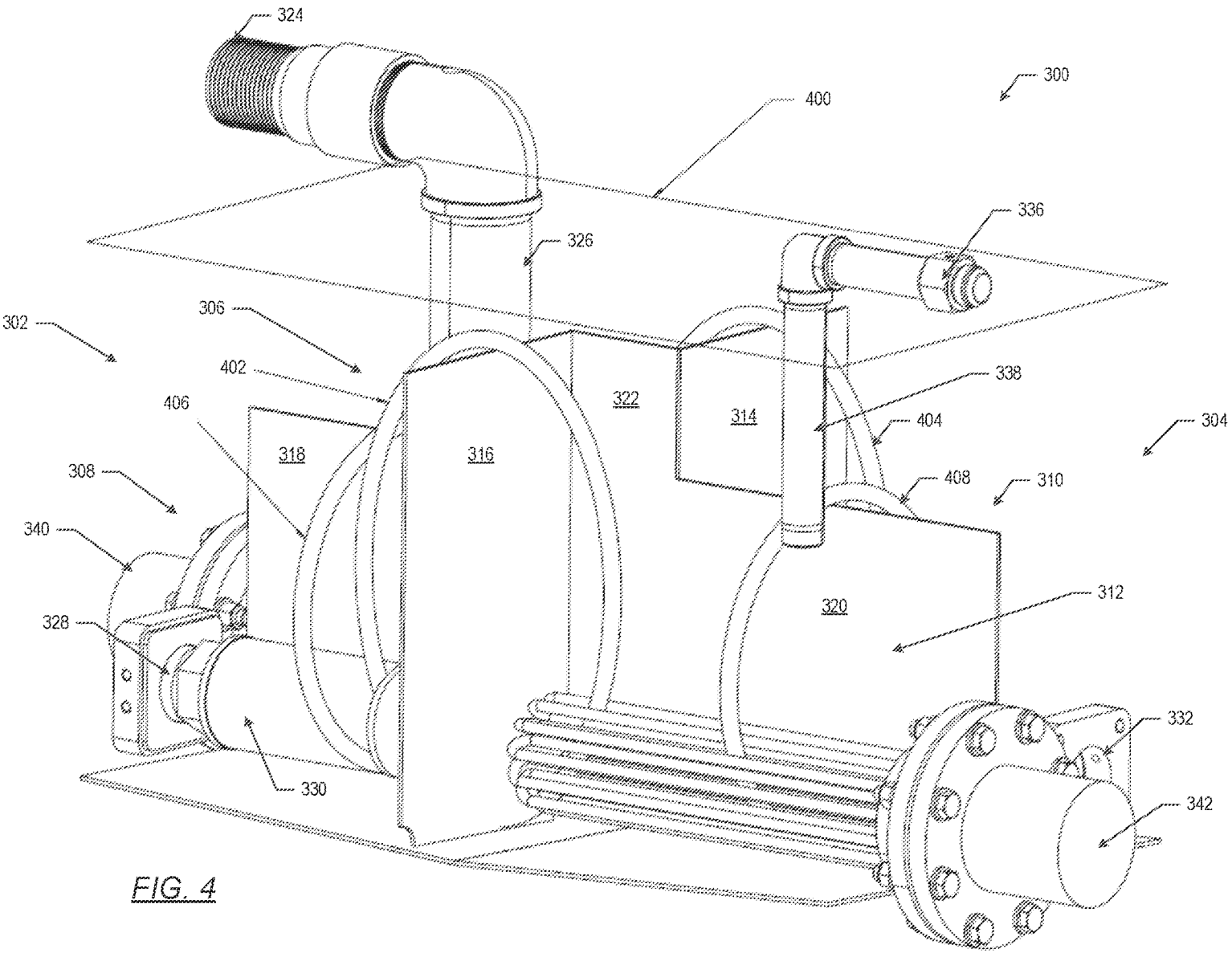

The different sets of baffles may be formed from a single body of material, with the body shaped to form the sets of baffles identified above. An example of this arrangement is shown in FIG. 4. However, the different sets of baffles may be individual pieces that are directly or indirectly connected to each other or placed near each other but not in a direct or indirect connected arrangement.

In other words, many different arrangements of the system of baffles shown in FIG. 3 are possible. The locations of the sets of baffles may also be changed. For example, the sets of baffles may be re-arranged to form four equal volumes or maybe re-arranged to form different volumes for each section. The heights of the baffles may be adjusted at different portions of one or more of the sets of baffles, or even along one set of baffles. In an embodiment, the sets of baffles that separate from the hot zone (302) from the cold zone (304) are taller than the sets of baffles that separate the sections from each other, as shown in FIG. 4.

Each set of baffles interferes with, but does not completely prevent, the transmission of lubricant from one section to another. Thus, for example, at least some lubricant in the hot zone (302) may flow into the cold zone (304), and vice versa. Likewise, at least some lubricant in the primary return section (306) may flow between and among the secondary suction section (308), the primary suction section (310), and the secondary return section (312). In an embodiment, regardless of where the lubricant is disposed within the reservoir (114), the pressure of the lubricant, and thus a lubricant level, within the reservoir (300) will equalize with an ambient pressure above the reservoir (300) (e.g., atmospheric pressure if the reservoir (300) is open to the air or otherwise able to equalize with atmospheric pressure, as described with respect to FIG. 1 and FIG. 2).

Nevertheless, the baffles tend to restrain the amount of lubricant that may flow between the zones and sections, relative to how the lubricant would perfuse through the reservoir (300) had the sets of baffles not been present. As a result, masses of lubricant at different temperatures tend to be constrained within a designated section and thus within a designated zone.

The zones are now defined with specificity. The boundary between hot zone (302) and the cold zone (304) is defined by the first baffle (314) and the second baffle (316), as well as by portions of the third baffle (318) or the fourth baffle (320) (i.e., the middle baffle portion (322)). The hot zone (302) is to the left of the first baffle (314) and to the left of the second baffle (316) in FIG. 3. The cold zone (304) is to the right of the first baffle (314) and to the right of the second baffle (316) in FIG. 3.

However, as indicated above, many different arrangements of the sets of baffles are possible. Furthermore, the hot zone (302) could be on the right side of the reservoir (300), or possibly on the top or bottom side of the reservoir (300) as shown in FIG. 3. Similarly, the inlets and outlets of the reservoir (300) may be re-arranged. Accordingly, the cold zone (304) could be on the left side of the reservoir (300), or possibly on the top or bottom side of the reservoir (300), as shown in FIG. 3. Thus, the example of FIG. 3 does not necessarily limit the one or more embodiments.

The sections are now defined with specificity. The primary return section (306) is defined between the first baffle (314) and the third baffle (318), including the middle baffle portion (322). Lubricant within the primary return section (306) is returned from the machine loop. In other words, the machine loop drain (324) is in fluid communication with the primary return section (306). Machine loop drain piping (326) may be used to force lubricant draining from the machine loop to enter the reservoir (300) at a pre-determined depth within the reservoir (300).

The secondary suction section (308) is defined between the third baffle (318) and the second baffle (316). Lubricant within the secondary suction section (308) is drawn into the thermal management loop inlet (328) through thermal management loop inlet piping (330). A pump that draws the lubricant may be located outside the reservoir (300), such as shown in FIG. 1 or maybe inside the reservoir (300) (not shown). The thermal management loop inlet piping (330) may include a filter in some embodiments. The thermal management loop inlet (328) is in fluid communication with the secondary suction section (308). Thus, lubricant within the secondary suction section (308) is drawn into the thermal management loop.

The primary suction section (310) is defined between the first baffle (314) and the fourth baffle (320). Lubricant within the primary suction section (310) is drawn into a machine loop inlet (332) through machine loop inlet piping (334). A pump that draws the lubricant may be located outside the reservoir (300), as shown in FIG. 1, or in some embodiments, the pump may be located inside the reservoir (300) (not shown). The machine loop inlet piping (334) may include a filter, in some embodiments. The machine loop inlet (332) is in fluid communication with the primary suction section (310). Thus, lubricant within the primary suction section (310) is drawn into the machine loop.

The secondary return section (312) is defined between the second baffle (316), the fourth baffle (320), and the middle baffle portion (322). Lubricant within the secondary return section (312) is returned from the thermal management loop. In other words, the thermal management loop drain (336) is in fluid communication with the secondary return section (312). Thermal management loop drain piping (338) may be used to force lubricant draining from the thermal management loop to enter the reservoir (300) at a pre-determined depth within the reservoir (300).

One or more of the sections may include additional equipment. For example, the primary return section (306) may be provided with a first immersion heater (340). Similarly, the secondary return section (312) may be provided with a second immersion heater (342). The immersion heaters may be used to heat the lubricant in each of the respective sections.

The reservoir (300) shown in FIG. 3, together with the sets of baffles described above, achieve better thermal exchange efficiency in a dual loop system, such as that shown in FIG. 1 or FIG. 2, while concurrently maintaining different ranges of pressure engineering tolerances in the thermal management loop and the machine loop. However, because the sets of baffles separating a zone into sections are shorter, and the sets of baffles separating the hot zone and the cold zone are taller, more of the hot lubricant enters the thermal management loop and more of the cold lubricant enters the machine loop, relative to using a simple tank reservoir without baffles. Thus, the reservoir (300) improves the thermal exchange efficiency of the dual loop system described with respect to FIG. 1 or FIG. 2.

Figure 5:
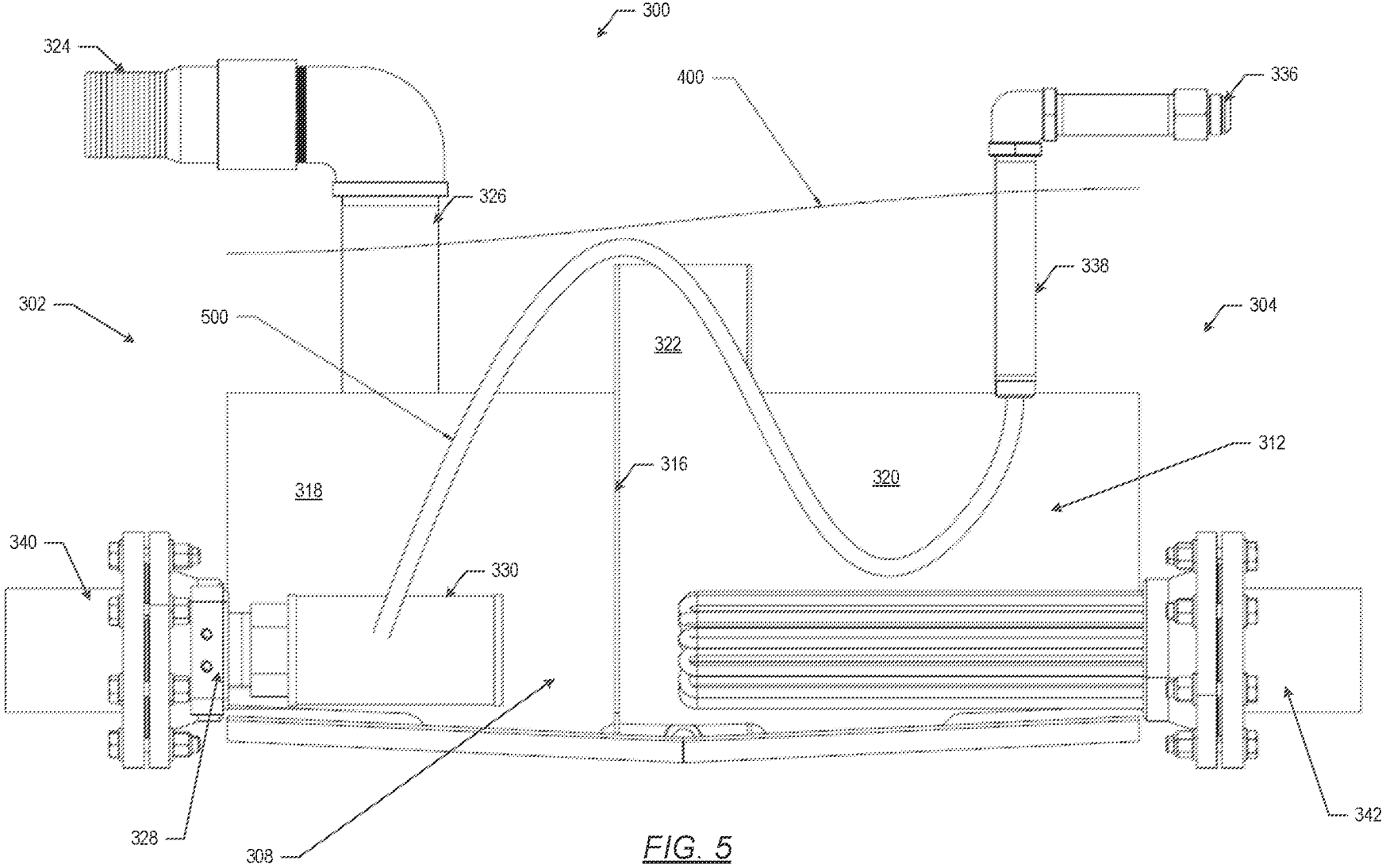
Figure 6:
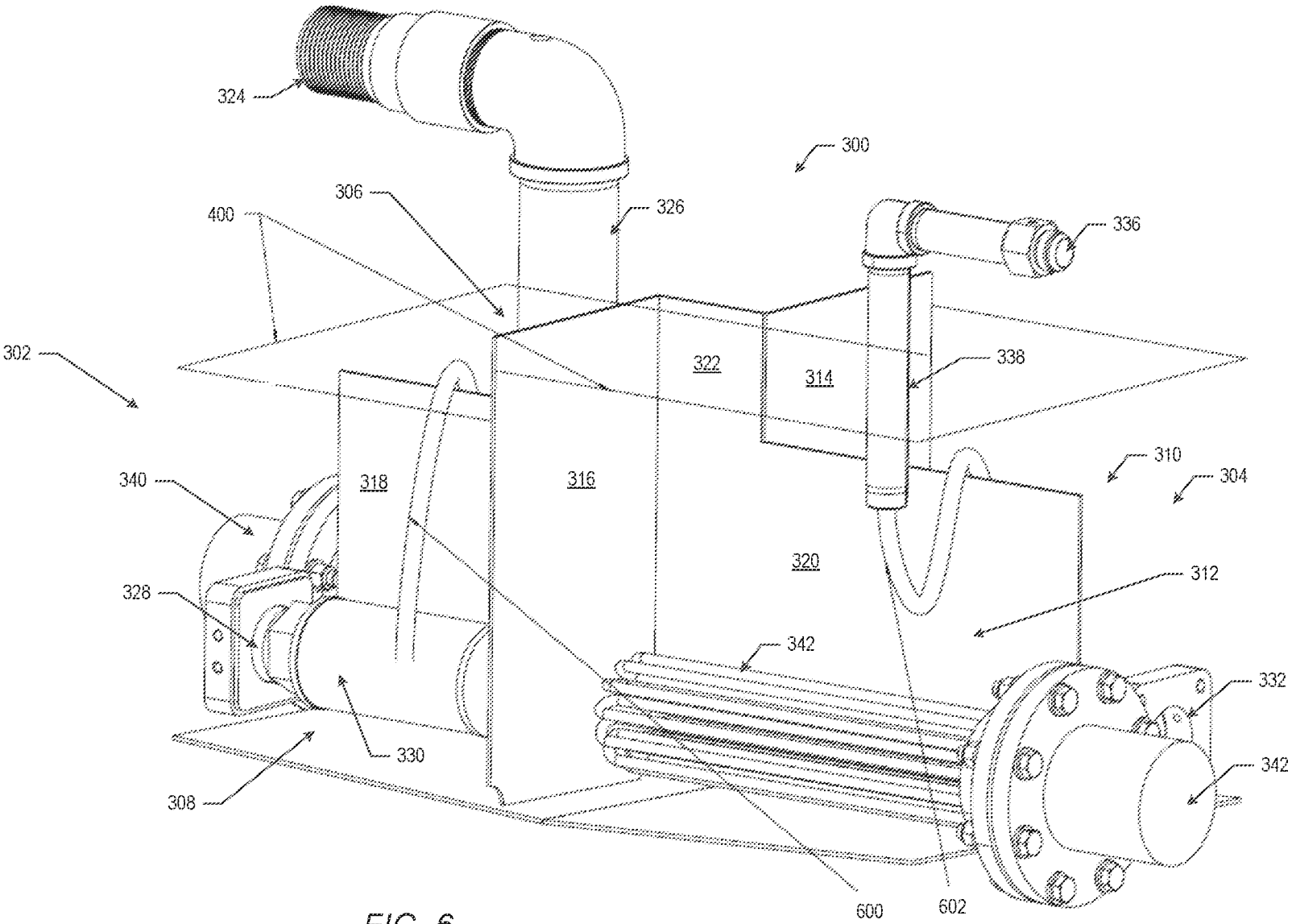

FIG. 4 through FIG. 6 show different views of the reservoir (300) shown in FIG. 3. In particular, FIG. 4 through FIG. 6 show flow paths of fluid between the different zones and sections. Again, reference numerals in FIG. 4 through FIG. 6 in common with reference numerals used in FIG. 3 refer to the same objects having similar definitions. Additionally, the views of FIG. 4 through FIG. 6 show the reservoir operating in different states. In FIG. 4, there is no loop running, just convection currents created by the heaters. In FIG. 5, only the secondary loop is running, drawing from the left, returning on the right. In FIG. 6, both loops are running, with flow being limited to within the hot zone and within the cold zone.

FIG. 4 shows a cut-away perspective view of the reservoir (300). For reference, FIG. 4 shows the hot zone (302), the cold zone (304), the primary return section (306), the secondary suction section (308), the primary suction section (310), the secondary return section (312), the first baffle (314), the second baffle (316), the third baffle (318), the fourth baffle (320), the middle baffle portion (322), the machine loop drain (324), the machine loop drain piping (326), the thermal management loop inlet (328), the through thermal management loop inlet piping (330), the machine loop inlet (332), the thermal management loop drain (336), the thermal management loop drain piping (338), the first immersion heater (340), and the second immersion heater (342).

FIG. 4 also show a fluid surface level (400) of the lubricant disposed within the reservoir (300). Areas below the fluid surface level (400) are immersed in lubricant. However, sub-surface currents of lubricant tend to flow between and among the zones and sections.

For example, the flow lines (402) indicate that a current of lubricant flows between the hot zone (302) and the cold zone (304), and specifically between the secondary suction section (308) and the secondary return section (312). Similarly, the flow lines (404) indicate that another current of lubricant flows between the hot zone (302) and the cold zone (304), and specifically between the primary return section (306) and the primary suction section (310).

Additionally, the lubricant flows between sections within a zone. Thus, for example, the flow lines (406) indicate that a current of lubricant flows between the secondary suction section (308) and the primary return section (306). Similarly, the flow lines (408) indicate that a current of lubricant flows between the secondary return section (312) and the primary suction section (310).

The flow lines (402), flow lines (404), flow lines (406), and flow lines (408) are not necessarily the only paths that sub-surface currents of lubricant can take within the reservoir (300). For example, a sub-surface current of lubricant can flow from the secondary return section (312) to the primary return section (306), and vice versa. However, such a sub-surface current may not occur when the loops are not running and only the heater produces convection currents. In this case, lubricant will rise up above the heaters and sink down above the suction strainers.

FIG. 5 shows a side view of the reservoir (300). For reference, FIG. 5 shows the hot zone (302), the cold zone (304), the secondary suction section (308), the secondary return section (312), the second baffle (316), the third baffle (318), the fourth baffle (320), the middle baffle portion (322), the machine loop drain (324), the machine loop drain piping (326), the thermal management loop inlet (328), the through thermal management loop inlet piping (330), the thermal management loop drain (336), the thermal management loop drain piping (338), the first immersion heater (340), the second immersion heater (342), and the fluid surface level (400).

FIG. 5 also shows another flow path of a sub-surface current in the lubricant when the secondary loop is active. In particular, flow lines (500) indicate that lubricant may flow from the thermal management loop drain (336), into the secondary return section (312), over the second baffle (316), and into the secondary suction section (308), drawn by the suction at the thermal management loop inlet (328). As a result, some of the cooler lubricant from the thermal management loop drain piping (338) mixes with the hotter lubricant draining from the machine loop drain piping (326). Nevertheless, due to the higher height of the second baffle (316) relative to the third baffle (318) and the fourth baffle (320), more of the hotter lubricant stays within the hot zone (302), relative to the cold zone (304). As a result, relatively hotter lubricant enters the thermal management loop inlet (328), to be cooled in the thermal management loop.

Stated differently, the hot zone (302) is further divided by one or more sets of baffles (e.g., the third baffle (318) and the middle baffle portion (322) into a primary return section (306) and a secondary suction section (308). The cold zone (304) is further subdivided by one or more sets of baffles (e.g., the fourth baffle (320) and the middle baffle portion (322)) into a primary suction section (310) and secondary return section (312). A first subset set of baffles separating the hot zone and the cold zone (e.g., the first baffle (314), the second baffle (316), or the middle baffle portion (322)) are higher in the reservoir than a second subset of baffles separating sections (e.g., the third baffle (318) or the fourth baffle (320)). As a result, more lubricant is permitted to flow between the sections (e.g., between the primary return section (306) and the secondary suction section (308), or between the primary suction section (310) and the secondary return section (312)) than between the hot zone (302) and the cold zone (304).

FIG. 6 shows still other flow lines of sub-surface currents of lubricant within the reservoir (300) when both loops are active and the reservoir level has decreased due to more lubricant accumulating in the machine. FIG. 6 also shares reference numerals in common with FIG. 3 and FIG. 4. For reference, FIG. 6 shows the hot zone (302), the cold zone (304), the primary return section (306), the secondary suction section (308), the primary suction section (310), the secondary return section (312), the first baffle (314), the second baffle (316), the third baffle (318), the fourth baffle (320), the middle baffle portion (322), the machine loop drain (324), the machine loop drain piping (326), the thermal management loop inlet (328), the through thermal management loop inlet piping (330), the machine loop inlet (332), the thermal management loop drain (336), the thermal management loop drain piping (338), the first immersion heater (340), the second immersion heater (342), and the fluid surface level (400).

The flow lines (600) indicate that a sub-surface current of lubricant may flow between the primary return section (306) and the secondary suction section (308). Because the third baffle (318) are relatively short compared to the first baffle (314) and the second baffle (316), hot lubricant (hot relative to the lubricant entering the reservoir (300) after cooling) entering the reservoir (300) via the machine loop drain piping (326) may flow more easily to the secondary suction section (308). Additionally, it is important to note that the lubricant level may have dropped below the higher baffles (i.e., the first baffle (314), the second baffle (316), and the middle baffle portion (322), which may significantly restrict flow from one zone to another. Accordingly, the lubricant entering the thermal management loop inlet (328) will be hotter (relative to a single tank system), resulting in increased thermal exchange efficiency in the thermal management loop.

Similarly, the flow lines (602) indicate that a sub-surface current of lubricant may flow between the secondary return section (312) and the primary suction section (310). Because the fourth baffle (320) are relatively short compared to the first baffle (314) and the second baffle (316), cool lubricant (cool relative to the lubricant entering the reservoir (300) after having passed through the machine) entering the reservoir (300) via the thermal management loop drain (336) may flow more easily to the machine loop inlet (332). Accordingly, the lubricant entering the machine loop inlet (332) will be cooler (relative to a single tank system), resulting in desirably cooler lubricant entering the machine loop.

The example of FIG. 3 through FIG. 6 shows a particular arrangement of components, such as the inlets, outlets, heaters, and sets of baffles. However, variations are possible. For example, more or fewer sections or zones are possible. In a specific example, the reservoir (300) may be configured for a three loop system that services two different machines that work in tandem with a common thermal management loop. In this case, the reservoir (300) may have five or more sections, or perhaps only three sections. Furthermore, the placement and shape of the sets of baffles may be varied from the examples shown in FIG. 6. More or fewer inlets, outlets, and heaters may be present.

The reservoir (300) may be provided with additional components not shown, such as one or more pressure valves, one or more fans, one or more sensors (e.g., a lubricant level sensor to sense a level of the lubricant within the reservoir (300)), or other equipment. For example, one or more of the zones and sections may be provided with thermometers that track the temperature of a zone or section. A feedback control system may change the operation of pumps, fans, valves, or other components in response to data measured from one or more of the thermometers.

The feedback control system may take a variety of different forms. For example, the feedback control system may include a means for communication (e.g. wired or wireless connections) that connect a sensor to a computer. The computer performs the calculations used to determine whether to adjust a component of the reservoir or the dual loop system. The feedback control system may also take the form of an application specific integrated circuit (ASIC), or some combination of one or more ASICs and one or more computers.

Many other variations are possible. Thus, the example of FIG. 3 through FIG. 6 does not necessarily limit other embodiments.

Figure 7:
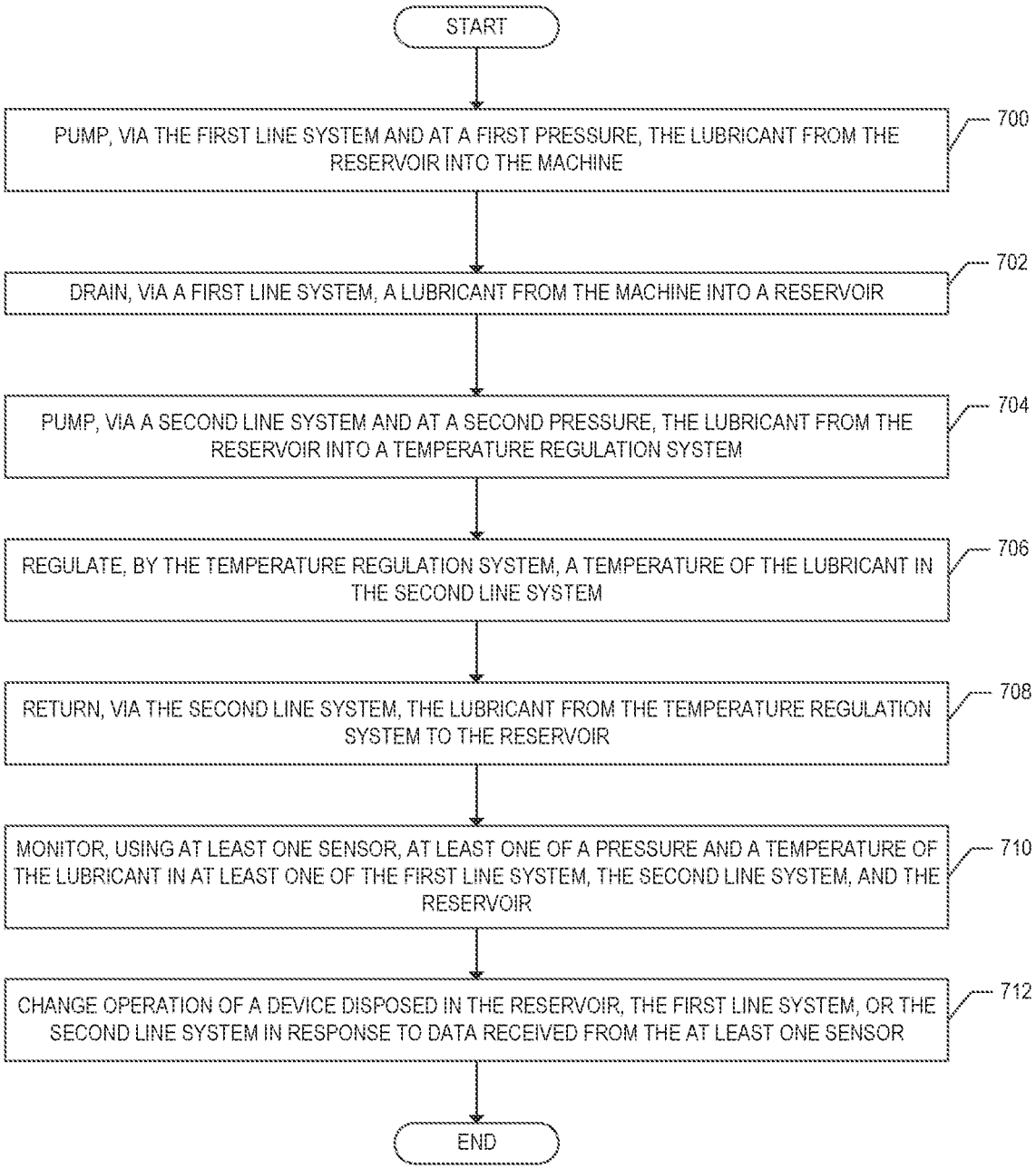
FIG. 7 shows a flowchart of a method of lubricating a machine, in accordance with one or more embodiments.

FIG. 7 shows a flowchart of a method of lubricating a machine, in accordance with one or more embodiments. The method of FIG. 7 may be performed using either the dual loop lubrication system (100) shown in FIG. 1 or the dual loop lubrication system (200) shown in FIG. 2.

Step 700 includes pumping, via the first line system and at a first pressure, the lubricant from the reservoir into the machine. Pumping may be accomplished using, for example, the first pump (122) in FIG. 1.

Step 702 includes draining, via a first line system, a lubricant from the machine into a reservoir. The first line system may be, for example, the machine loop (102) of FIG. 1 or the primary loop (202) of FIG. 2. Draining may be accomplished either by pumping the lubricant from the machine into the reservoir or by permitting to lubricant to flow out of the machine and into the reservoir, possibly via intervening lines.

Step 704 includes pumping, via a second line system and at a second pressure, the lubricant from the reservoir into a temperature regulation system. Pumping at Step 704 may be accomplished using, for example, the second pump (132) of FIG. 1. The second pressure is less than the first pressure. The second pressure is out of a first lubricant pressure tolerance for the machine. The first pressure is out of a second lubrication pressure tolerance of the temperature regulation system.

Step 706 includes regulating, by the temperature regulation system, a temperature of the lubricant in the second line system. For example, the lubricant may be cooled or heated in the temperature regulation system, as described with respect to the thermal management system (138) in FIG. 1.

Step 708 includes returning, via the second line system, the lubricant from the temperature regulation system to the reservoir. The lubricant may be returned by virtue of the lubricant pressure within the second loop, as generated by the second pump. Alternatively, the lubricant may be allowed to drain via gravity into the reservoir. In one embodiment, the method of FIG. 7 may terminate thereafter.

However, the method of FIG. 7 may be varied or extended. For example, the method may include using a control system to regulate one or more properties of the lubricant in either or both the first loop and second loop. In a specific example, at step 710, the method may include monitoring, using at least one sensor, at least one of a pressure and a temperature of the lubricant in at least one of the first line system, the second line system, and the reservoir. Then, at step 712, the method may include changing operation of a device disposed in the reservoir, the first line system, or the second line system in response to data received from the at least one sensor.

For example, the method may also include measuring at least one property of the lubricant using a sensor connected to at least one of the reservoir, the first line system, and the second line system. In this case, the method may also include controlling, based the at least one property, at least one of: the machine, the first pressure, the second pressure, and the temperature. In a specific example, if the pressure in the thermal management loop is above an engineering tolerance, as measured by a sensor, then a control circuit that receives the sensor data as input may output a control signal that lowers the pressure applied by the second pump. However, many different examples are possible with respect to regulating many different properties of the lubricant within either loop. Similarly, the viscosity of the lubricant may be regulated by monitoring the viscosity of the lubricant in one or more portions of the two loops or in the reservoir, and the lubricant may be heated or cooled until the viscosity of the lubricant is within a predetermined range of viscosity values.

The method of FIG. 7 may be further varied or extended. For example, the method may also include filtering the lubricant in at least one of the first line system and the second line system. Filtering may include a multi-stage filter (e.g. a strainer for particles in one size range, and a finer filter for particles in a second size range). A variety of different filters may be used, including but not limited to gratings, screens, paper, ceramic, etc.

Figure 8:
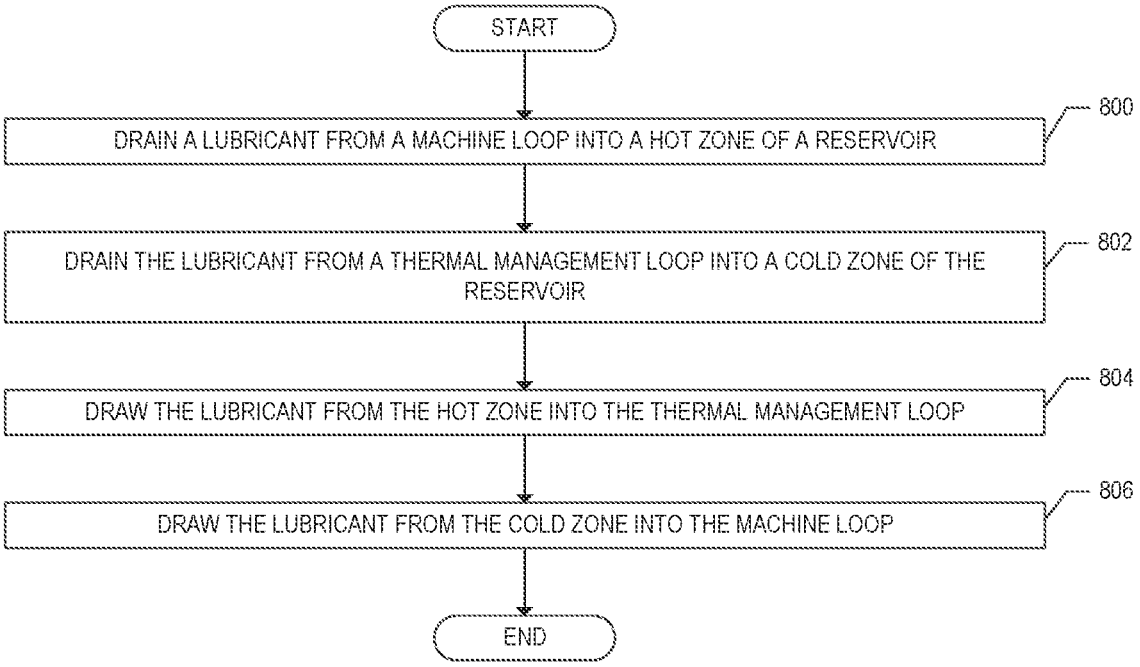
FIG. 8 shows a flowchart of processing lubricant in a reservoir for a dual loop lubrication system, in accordance with one or more embodiments.

FIG. 8 shows a flowchart of processing lubricant in a reservoir for a dual loop lubrication system, in accordance with one or more embodiments. The method of FIG. 8 may be performed using the dual loop lubrication system (100) shown in FIG. 1 or the dual loop lubrication system (200) shown in FIG. 2.

Step 800 includes draining a lubricant from a machine loop into a hot zone of a reservoir. The lubricant may be drained into the reservoir via a machine outlet connected to a machine loop of a dual loop system, as shown in FIG. 1. The lubricant drained into the hot zone is at a higher temperature than the lubricant entering the reservoir from a thermal management loop of the dual loop system.

Step 802 includes draining the lubricant from a thermal management loop into a cold zone of the reservoir. The lubricant may be drained into the reservoir via a thermal management outlet connected to a thermal management loop of a dual loop system, as shown in FIG. 1. The hot zone and the cold zone of the reservoir are separated by one or more sets of baffles that permit at least some flow of the lubricant between the hot zone and the cold zone, as shown in FIG. 3 through FIG. 6.

Step 804 includes drawing the lubricant from the hot zone into the thermal management loop. For example, a pump in the thermal management loop may draw the lubricant in the hot zone through a thermal management inlet of the reservoir. The lubricant is then cycled through the thermal management loop, within which the temperature of the lubricant is adjusted (warmed or cooled, as desired). After adjustment of the temperature of the lubricant (e.g., cooling), the lubricant will re-enter the reservoir through the thermal management drain, as in step 802. Thus, a continuous loop of lubricant flow may be established between the reservoir and the thermal management loop.

Step 806 includes drawing the lubricant from the cold zone into the machine loop. For example, a pump in the machine loop may draw the lubricant in the cold zone through a machine inlet of the reservoir. The lubricant is then cycled through the machine loop, within which the temperature of the lubricant is increased via operation of the machine. After increasing the temperature of the lubricant, the lubricant will re-enter the reservoir through the machine loop drain, as in step 800. Thus, a continuous loop of lubricant flow may be established between the reservoir and the machine loop. In an embodiment, the method of FIG. 8 may terminate after step 806 or continuously repeat between steps 800 through 804.

However, the method of FIG. 8 may be extended. For example, the method may also include monitoring, using at least one sensor, at least one of a lubricant level, and a temperature of the lubricant in at least one of the hot zones and the cold zone. The at least one sensor may be placed in one or more locations within the reservoir, or within one or more locations along either one of the machine loops or the thermal management loop. The at least one sensor may generate data for later use, below. The one or more embodiments the use of multiple sensors of multiple different types (e.g., multiple pressure sensors and multiple temperature sensors distributed within the reservoir and the dual loop system). Many types of sensors are contemplated, such as pressure sensors, temperature sensors, flow rate sensors, viscosity sensors, oil purity (cleanliness), etc.

The method of FIG. 8 also may include changing operation of a device disposed of in the reservoir, the machine loop, or the thermal management loop in response to data received from at least one sensor. For example, the data generated above may be provided to a control system. The control system may compare the data to one or more threshold values. If the threshold values are met (e.g. equaled or exceeded) then the control system may be programmed to trigger or modify operation of a device. In a specific example, if the temperature of the lubricant exiting the machine loop is above a threshold temperature, then the pump that draws lubricant into the thermal management loop may be adjusted to increase the flow rate of lubricant entering the thermal management loop. In another specific example, if the pressure of the lubricant in the thermal management loop exceeds a threshold pressure value, then the pump may be adjusted to lower the lubricant pressure in the thermal management loop. Many different control system schemes are possible for changing operation of a device disposed in the reservoir, the machine loop, or the thermal management loop.

The method of FIG. 8 may be further varied. For example, consider the case where the hot zone is further divided by the one or more sets of baffles into a primary return section and a secondary suction section, and the cold zone is further subdivided by the one or more sets of baffles into a primary suction section and secondary return section. In this case, the method of FIG. 8 may include draining the lubricant from the machine loop into the primary return section of the hot zone; draining the lubricant from the thermal management loop into the secondary return section of the cold zone; drawing the lubricant from the primary suction section of the cold zone into the machine loop; and drawing the lubricant from the secondary suction section of the hot zone into the thermal management loop. Reference is made to FIG. 1 for an example of visualizing this further variation of FIG. 8.

In another variation, for example in cold weather environments, the method of FIG. 8 may also include heating, using a heater disposed in the reservoir, and the lubricant within the reservoir. The lubricant may be heated until a viscosity of the lubricant within the reservoir, or within a zone or section of the reservoir, reaches a pre-determined engineering tolerance for the viscosity.

Still, other variations are possible. Thus, the one or more embodiments are not necessarily limited to the examples described with respect to FIG. 8.

In the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Further, unless expressly stated otherwise, "or" is an "inclusive or" and, as such includes "and." Further, items joined by an or may include any combination of the items with any number of each item unless expressly stated otherwise.

The term "about," when used with respect to a physical property that may be measured, refers to an engineering tolerance anticipated or determined by an engineer or manufacturing technician of ordinary skill in the art. The exact quantified degree of an engineering tolerance depends on the product being produced and the technical property being measured. For a non-limiting example, two angles may be "about congruent" if the values of the two angles are within ten percent of each other. However, if an engineer determines that the engineering tolerance for a particular product should be tighter, then "about congruent" could be two angles having values that are within one percent of each other. Likewise, engineering tolerances could be loosened in other embodiments, such that "about congruent" angles have values within twenty percent of each other. In any case, the ordinary artisan is capable of assessing what is an acceptable engineering tolerance for a particular product, and thus is capable of assessing how to determine the variance of measurement contemplated by the term "about."

As used herein, the term "connected to" contemplates at least two meanings. In a first meaning, unless otherwise stated, "connected to" means that component A was, at least at some point, separate from component B, but then was later joined to component B in either a fixed or a removably attached arrangement. In a second meaning, unless otherwise stated, "connected to" means that component A could have been integrally formed with component B. Thus, for example, assume a bottom of a pan is "connected to" a wall of the pan. The term "connected to" may be interpreted as the bottom and the wall being separate components that are snapped together, welded, or are otherwise fixedly or removably attached to each other. Additionally, the term "connected to" also may be interpreted as the bottom and the wall being contiguously together as a monocoque body formed by, for example, a molding process. In other words, the bottom and the wall, in being "connected to" each other, could be separate components that are brought together and joined, or maybe a single piece of material that is bent at an angle so that the bottom panel and the wall panel are identifiable parts of the single piece of material.

In the above description, numerous specific details are set forth in order to provide a more thorough understanding. However, it will be apparent to one of ordinary skill in the art that the invention may be practiced without these specific details. In other instances, well-known features have not been described in detail to avoid unnecessarily complicating the description. Further, other embodiments not explicitly described above can be devised which do not depart from the scope as disclosed herein. Accordingly, the scope should be limited only by the attached claims.

What is claimed is:

1. A device comprising:

a reservoir configured to contain a lubricant;

one or more sets of baffles disposed in the reservoir, wherein the one or more sets of baffles separate the reservoir into a hot zone and a cold zone, and wherein the one or more sets of baffles permit at least some flow of the lubricant between the hot zone and the cold zone;

a machine loop drain placed in the reservoir to drain lubricant returning from a machine into the hot zone;

a thermal management loop drain placed in the reservoir to drain lubricant returning from a thermal management system into the cold zone;

a thermal management loop inlet placed in the reservoir to draw lubricant from the hot zone; and a machine loop inlet placed in the reservoir to draw lubricant from the cold zone.

2. The device of claim 1, wherein the one or more sets of baffles are further configured to separate the reservoir into a primary return section of the hot zone, a secondary suction section of the hot zone, a primary suction section of the cold zone, and a secondary return section of the cold zone.

3. The device of claim 2, wherein the machine loop drain is further placed in the reservoir to drain the lubricant returning from the machine into the primary return section.

4. The device of claim 2, wherein the thermal management loop inlet is further placed in the reservoir to draw the lubricant from the secondary suction section.

5. The device of claim 2, wherein the machine loop inlet is further placed in the reservoir to draw the lubricant from the primary suction section.

6. The device of claim 2, wherein the thermal management loop drain is further placed in the reservoir to drain the lubricant returning from a thermal management loop into the secondary return section.

7. The device of claim 2, wherein:

the machine loop drain is further placed in the reservoir to drain the lubricant returning from the machine into the primary return section, the thermal management loop inlet is further placed in the reservoir to draw the lubricant from the secondary suction section, the machine loop inlet is further placed in the reservoir to draw the lubricant from the primary suction section, and the thermal management loop drain is further placed in the reservoir to drain the lubricant returning from a thermal management loop into the secondary return section.

8. The device of claim 7, wherein the one or more sets of baffles comprise:

a first baffles separating the primary return section and the primary suction section, a second baffles separating secondary suction section and the secondary return section, a third baffles separating the primary return section and the secondary suction section, and a fourth baffles separating the primary suction section and the secondary return section.

9. The device of claim 8, wherein the third baffles and the fourth baffles share a middle baffle portion.

10. The device of claim 1, further comprising:

a heater disposed in at least one of the hot zone and the cold zone.

11. The device of claim 2, further comprising:

a first heater disposed in the primary return section; and a second heater disposed in the secondary return section.

12. A reciprocating pump system comprising:

a reciprocating pump;

a thermal management system;

a dual loop lubrication system comprising a machine loop connected to the reciprocating pump and a thermal management loop connected to the thermal management system;

a reservoir in fluid communication with the machine loop and the thermal management loop, the reservoir configured to contain a lubricant;

one or more sets of baffles disposed in the reservoir, wherein the one or more sets of baffles separate the reservoir into a hot zone and a cold zone, and wherein the one or more sets of baffles permit at least some flow of the lubricant between the hot zone and the cold zone;

a machine loop drain connected to the machine loop, placed in the reservoir to drain lubricant returning from the reciprocating pump into the hot zone;

a thermal management loop drain connected to the thermal management loop, placed in the reservoir to drain lubricant returning from the thermal management system into the cold zone;

a thermal management loop inlet connected to the thermal management loop, placed in the reservoir to draw lubricant from the hot zone; and a machine loop inlet connected to the machine loop, placed in the reservoir to draw lubricant from the cold zone.

13. The reciprocating pump system of claim 12, wherein the one or more sets of baffles are further configured to separate the reservoir into a primary return section of the hot zone, a secondary suction section of the hot zone, a primary suction section of the cold zone, and a secondary return section of the cold zone.

14. The reciprocating pump system of claim 13, wherein:

the machine loop drain is further placed in the reservoir to drain the lubricant returning from the reciprocating pump into the primary return section, the thermal management loop inlet is further placed in the reservoir to draw the lubricant from the secondary suction section and into the thermal management loop, the machine loop inlet is further placed in the reservoir to draw the lubricant from the primary suction section and into the machine loop, and the thermal management loop drain is further placed in the reservoir to drain the lubricant returning from the thermal management loop into the secondary return section.

15. The reciprocating pump system of claim 14, wherein the one or more sets of baffles comprise:

a first baffles separating the primary return section and the primary suction section, a second baffles separating secondary suction section and the secondary return section, a third baffles separating the primary return section and the secondary suction section, and a fourth baffles separating the primary suction section and the secondary return section.

16. The reciprocating pump system of claim 12, further comprising:

a heater disposed in at least one of the hot zone and the cold zone.

17. A method comprising:

draining a lubricant from a machine loop into a hot zone of a reservoir;

draining the lubricant from a thermal management loop into a cold zone of the reservoir, wherein the hot zone and the cold zone of the reservoir are separated by one or more sets of baffles that permit at least some flow of the lubricant between the hot zone and the cold zone;

drawing the lubricant from the hot zone into the thermal management loop; and drawing the lubricant from the cold zone into the machine loop.

18. The method of claim 17, wherein the hot zone is further divided by the one or more sets of baffles into a primary return section and a secondary suction section, wherein the cold zone is further subdivided by the one or more sets of baffles into a primary suction section and secondary return section, and wherein the method further comprises:

draining the lubricant from the machine loop into the primary return section of the hot zone;

draining the lubricant from the thermal management loop into the secondary return section of the cold zone;

drawing the lubricant from the primary suction section of the cold zone into the machine loop; and drawing the lubricant from the secondary suction section of the hot zone into the thermal management loop.

19. The method of claim 17, wherein:

the hot zone is further divided by the one or more sets of baffles into a primary return section and a secondary suction section, the cold zone is further subdivided by the one or more sets of baffles into a primary suction section and secondary return section, a first subset set of baffles separating the hot zone and the cold zone are higher in the reservoir than a second subset of baffles separating sections, and more lubricant is permitted to flow between the sections than between hot zone and the cold zone.

20. The method of claim 17, further comprising:

heating, using a heater disposed in the reservoir, the lubricant within the reservoir.

* * * * *